US009050822B2

(12) United States Patent
Kubo et al.

(10) Patent No.: US 9,050,822 B2
(45) Date of Patent: Jun. 9, 2015

(54) LIQUID EJECTING DEVICE, LIQUID EJECTING METHOD AND RECORDING MEDIUM STORING PROGRAMS FOR LIQUID EJECTING DEVICE

(71) Applicants: Isao Kubo, Tokoname (JP); Hidenobu Kondo, Aichi (JP); Kyoichi Morita, Anjo (JP); Takahiro Ikeno, Seto (JP)

(72) Inventors: Isao Kubo, Tokoname (JP); Hidenobu Kondo, Aichi (JP); Kyoichi Morita, Anjo (JP); Takahiro Ikeno, Seto (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 14/107,035

(22) Filed: Dec. 16, 2013

(65) Prior Publication Data

US 2014/0168300 A1 Jun. 19, 2014

(30) Foreign Application Priority Data

Dec. 17, 2012 (JP) ..... 2012-274630

(51) Int. Cl.
*B41J 29/38* (2006.01)
*B41J 29/393* (2006.01)
(Continued)

(52) U.S. Cl.
CPC ..... *B41J 2/2135* (2013.01); *B41J 11/008* (2013.01); *B41J 11/0095* (2013.01)

(58) Field of Classification Search
CPC .. B41J 11/0065; B41J 11/0095; B41J 11/007; B41J 29/38; B41J 29/393; B41J 2/2135; B41J 11/008
USPC ..... 347/8, 11, 14, 16, 19
See application file for complete search history.

(56) References Cited

U.S. PATENT DOCUMENTS 5,874,979 A 2/1999 Ohyama
6,471,315 B1 10/2002 Kurata
7,237,858 B2 7/2007 Igarashi
(Continued)

FOREIGN PATENT DOCUMENTS

JP HEI 05-155009 A 6/1993
JP HEI 9-48161 A 2/1997
(Continued)

OTHER PUBLICATIONS

U.S. Office Action dated Nov. 19, 2014 received in related U.S. Appl. No. 14/341,015.
(Continued)

*Primary Examiner* — Jannelle M Lebron
(74) *Attorney, Agent, or Firm* — Scully, Scott, Murphy & Presser, P.C.

(57) ABSTRACT

A liquid ejecting device has a liquid ejecting head to eject ink to a sheet-like object, a carriage mounting the liquid ejecting head, a conveying device which conveys the sheet-like object with holding the sheet-like object to have a corrugated shape having a corrugated cross-section in the scanning direction, a detecting unit which detects an end portion of the sheet-like object in the scanning direction, and a processor. The processor is configured to execute instructions to provide an ejection timing determining unit configured to determine an ejection timing at which the liquid is ejected from the liquid ejecting head in accordance with positional information representing the end portion detected by the detecting unit and reference information, and an ejection control unit configured to control the liquid ejecting head and the carriage to eject the liquid from the liquid ejecting head at the timing determined by the ejection timing determining unit.

14 Claims, 12 Drawing Sheets

(51) Int. Cl.
*B41J 2/21* (2006.01)
*B41J 11/00* (2006.01)

(56) References Cited

U.S. PATENT DOCUMENTS

| | | | | |
|---|---|---|---|---|
| 8,567,905 | B2 | 10/2013 | Ogasawara | |
| 2004/0126164 | A1 | 7/2004 | Ohyama | |
| 2005/0088471 | A1* | 4/2005 | Endo | 347/16 |
| 2007/0291056 | A1 | 12/2007 | Tanahashi et al. | |
| 2009/0219322 | A1 | 9/2009 | Terada | |
| 2010/0039473 | A1 | 2/2010 | Terada | |
| 2010/0244357 | A1* | 9/2010 | Takahata | 271/4.08 |
| 2011/0063352 | A1 | 3/2011 | Sakurada et al. | |
| 2011/0157269 | A1 | 6/2011 | Teramae | |
| 2011/0175958 | A1 | 7/2011 | Sato et al. | |
| 2011/0298854 | A1 | 12/2011 | Sakurada et al. | |
| 2014/0204141 | A1 | 7/2014 | Arakane | |

FOREIGN PATENT DOCUMENTS

| | | | |
|---|---|---|---|
| JP | HEI 11-240146 | A | 9/1999 |
| JP | 2004-017586 | A | 1/2004 |
| JP | 2004-106978 | A | 4/2004 |
| JP | 2005-246642 | A | 9/2005 |
| JP | 2006-102997 | A | 4/2006 |
| JP | 2006-192636 | A | 7/2006 |
| JP | 2007-144718 | A | 6/2007 |
| JP | 2007-331297 | A | 12/2007 |
| JP | 2007-331315 | A | 12/2007 |
| JP | 2008-221729 | A | 9/2008 |
| JP | 2009-128822 | A | 6/2009 |
| JP | 2009-143152 | A | 7/2009 |
| JP | 2009-196367 | A | 9/2009 |
| JP | 2009-202430 | A | 9/2009 |
| JP | 2009-208273 | A | 9/2009 |
| JP | 2010-042646 | A | 2/2010 |
| JP | 2011-079296 | A | 4/2011 |
| JP | 2014-136419 | A | 7/2014 |
| JP | 2014-139002 | A | 7/2014 |

OTHER PUBLICATIONS

U.S. Office Action dated Nov. 20, 2014 received in related U.S. Appl. No. 14/341,080.

U.S. Office Action dated Dec. 24, 2014 received in related U.S. Appl. No. 14/158,000.

U.S. Patent Application filed Jul. 25, 2014, namely U.S. Appl. No. 14/341,080.

U.S. Patent Application filed Jul. 25, 2014, namely U.S. Appl. No. 14/341,015.

Notice of Allowance dated Mar. 5, 2015 issued in U.S. Appl. No. 14/341,080.

U.S. Office Action dated Mar. 20, 2015 issued in U.S. Appl. No. 14/158,000.

Notice of Allowance dated Mar. 20, 2015 issued in U.S. Appl. No. 14/341,015.

* cited by examiner

FIG. 7A
FIG. 7B
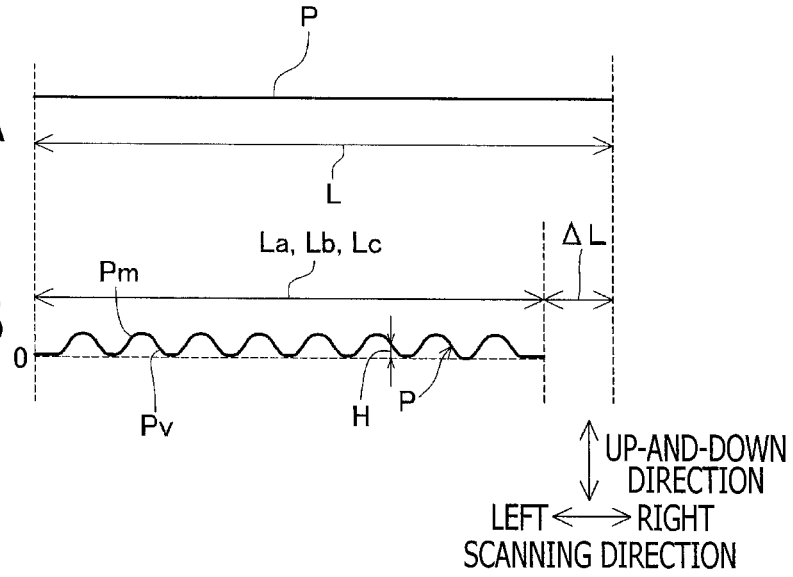
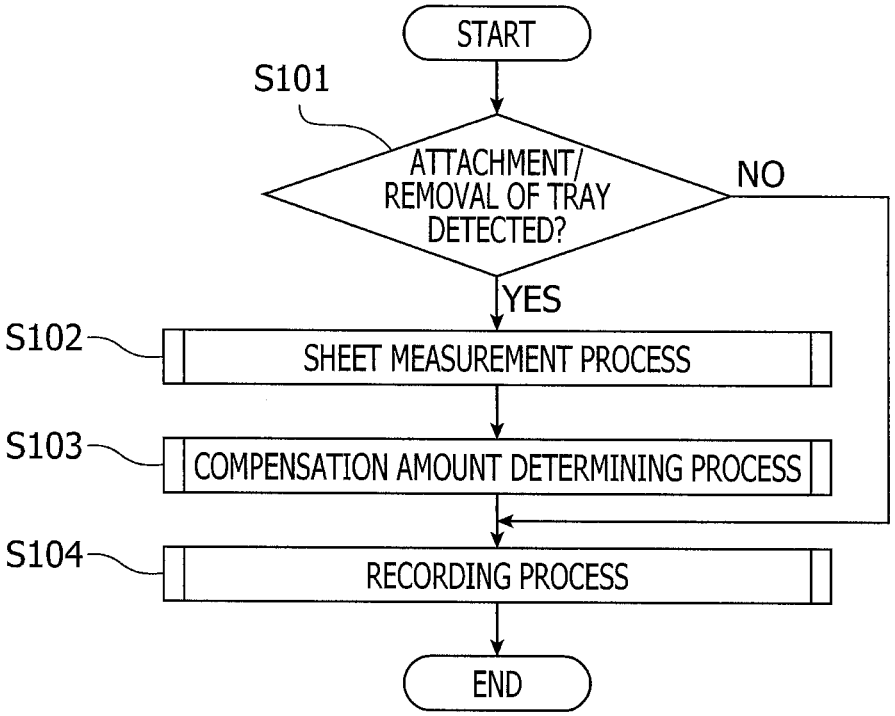
FIG. 8

LIQUID EJECTING DEVICE, LIQUID EJECTING METHOD AND RECORDING MEDIUM STORING PROGRAMS FOR LIQUID EJECTING DEVICE

CROSS-REFERENCE TO RELATED APPLICATION

This application claims priority under 35 U.S.C. §119 from Japanese Patent Application No. 2012-274630 filed on Dec. 17, 2012. The entire subject matter of the application is incorporated herein by reference.

BACKGROUND

1. Technical Field

Aspects of the invention relate to a liquid ejecting device configured to eject liquid toward a medium through nozzles formed thereon. Aspects of the invention also relate to a liquid ejecting method to be employed in a liquid ejecting device, and a computer-readable recording medium storing instruction to be executed by a processor of a liquid ejecting device.

2. Conventional Art

Inkjet printers configured to eject ink from an inkjet head which is reciprocally moved in a scanning direction to a medium such as a print sheet have been known as an example of a liquid ejecting device. Typically, the inkjet printer has a platen which supports the medium from below. Among the conventional inkjet printers, one which is configured such that a plurality of projections are formed in the scanning direction with evenly spaced from each other has been known. With this configuration, the sheet is kept to have a corrugated shape. According to such a configuration, a distance between the sheet and the inkjet head varies depending on a portion on the sheet in the scanning direction. Therefore, it is necessary to adjust a timing at which each ink drop reaches the sheet so as to make a distance between adjacent ink drops evenly.

SUMMARY

Even if the platen is designed to have a plurality of protrusions, when the sheet is a relatively rigid sheet such as a glossy paper, the sheet is hardly shaped to have the corrugated shape. Even if the sheet is made to have the corrugated shape, it may not be different from the designed (expected) one depending on the rigidity of the sheet. In such a case (i.e., the sheet does not have the designed corrugated shape), if the liquid ejection timing from the nozzles are controlled without taking the above difference due to the type of the sheet into account, the drops of the liquid may not reach appropriate positions on the sheet.

In consideration of the above, aspects of the present invention provide an improved liquid ejecting device, liquid ejecting method and recording medium containing a program to control the liquid ejecting device.

According to aspects of the invention, there is provided a liquid ejecting device, which has a liquid ejecting head configured to eject ink to a sheet-like object, a carriage mounting the liquid ejecting head thereon, the carriage being reciprocally movable relative to the object in a scanning direction, a conveying device configured to convey the sheet-like object in a conveying direction which is perpendicular to the scanning direction with holding the sheet-like object to have a corrugated shape exhibiting a corrugation in cross-section taken along a plane extending in the scanning direction and perpendicular to the conveying direction, a detecting unit configured to detect an end portion of the sheet-like object in the scanning direction, and a processor. The processor is configured to execute instructions to provide an ejection timing determining unit configured to determine an ejection timing at which the liquid is ejected from the liquid ejecting head in accordance with positional information representing the end portion detected by the detecting unit and reference information, and an ejection control unit configured to control the liquid ejecting head and the carriage to eject the liquid from the liquid ejecting head at the timing determined by the ejection timing determining unit.

According to aspects of the invention, there is provided a liquid ejecting method for a liquid ejecting device having a liquid ejecting head configured to eject ink to a sheet-like object, a carriage mounting the liquid ejecting head thereon, the carriage being reciprocally movable relative to the object in a scanning direction, and a conveying device configured to convey the sheet-like object in a conveying direction. The liquid ejecting method includes conveying the sheet-like object with holding the sheet-like object to be deformed to have a corrugated shape exhibiting a corrugation in cross-section taken along a plane extending in the scanning direction and perpendicular to the conveying direction, detecting an end portion of the sheet-like object in the scanning direction, determining an ejection timing at which the liquid is ejected from the liquid ejecting head in accordance with positional information representing the end portion as detected and reference information, and controlling the liquid ejecting head and the carriage to eject the liquid from the liquid ejecting head at the timing determined by execution of determining the ejection timing.

According to aspects of the invention, there is provided a non-transitory computer-readable storage medium containing executable instructions regarding a liquid ejecting method for a liquid ejecting device which has a liquid ejecting head configured to eject ink to a sheet-like object, a carriage mounting the liquid ejecting head thereon, the carriage being reciprocally movable relative to the object in a scanning direction, and a conveying device configured to convey the sheet-like object in a conveying direction. The instructions cause, when executed, a computer to execute conveying the sheet-like object with holding the sheet-like object to be deformed to have a corrugated shape, detecting an end portion of the sheet-like object in the scanning direction, determining an ejection timing at which the liquid is ejected from the liquid ejecting head in accordance with positional information representing the end portion as detected and reference information, and controlling the liquid ejecting head and the carriage to eject the liquid from the liquid ejecting head at the timing determined by execution of determining the ejection timing.

According to aspects of the invention, there is provided a liquid ejecting device, which has a liquid ejecting head configured to eject ink toward a sheet-like object, a carriage mounting the liquid ejecting head thereon, the carriage being reciprocally movable relative to the sheet-like object in a scanning direction, a conveying device configured to convey the sheet-like object in a conveying direction which is perpendicular to the scanning direction with holding the sheet-like object to have a corrugated shape exhibiting a corrugation in cross-section taken along a plane extending in the scanning direction and perpendicular to the conveying direction, a detecting unit configured to detect an end portion of the sheet-like object in the scanning direction. The liquid ejecting device further has an integrated circuit which is configured to be implemented with an ejection timing determining function to determine an ejection timing at which the liquid is ejected from the liquid ejecting head in accordance with positional information representing the end portion detected by the detecting unit and reference information, and an ejection control function to control the liquid ejecting head and the carriage to eject the liquid from the liquid ejecting head at the timing determined by the ejection timing determining function.

BRIEF DESCRIPTION OF THE ACCOMPANYING DRAWINGS

FIG. 7A shows a length of the sheet when the sheet has a corrugated shape.

FIG. 7B shows a length of the sheet when the sheet has the corrugated shape.

FIG. 8 is a flowchart illustrating a recording process executed by the control unit of the inkjet printer according to the embodiment of the invention.

DETAILED DESCRIPTION OF THE EMBODIMENT

Figure 1:
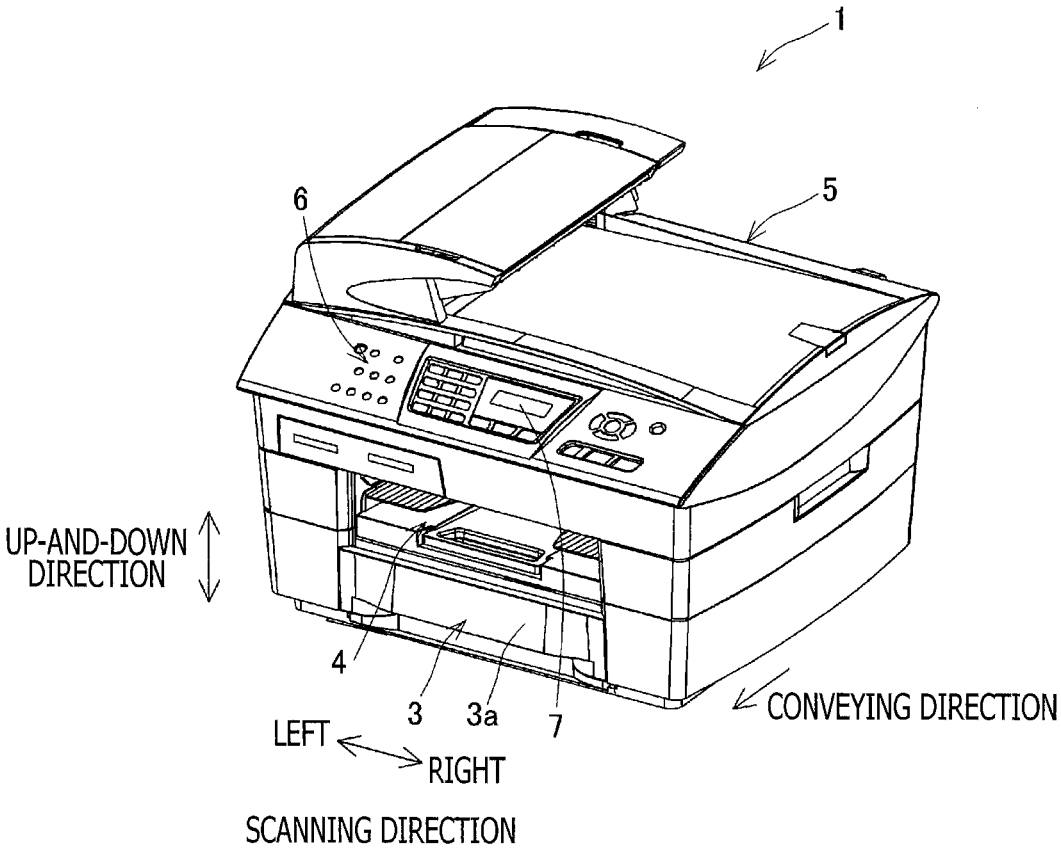
FIG. 1 is a perspective view of an inkjet printer according to an embodiment of the invention.
Figure 2:
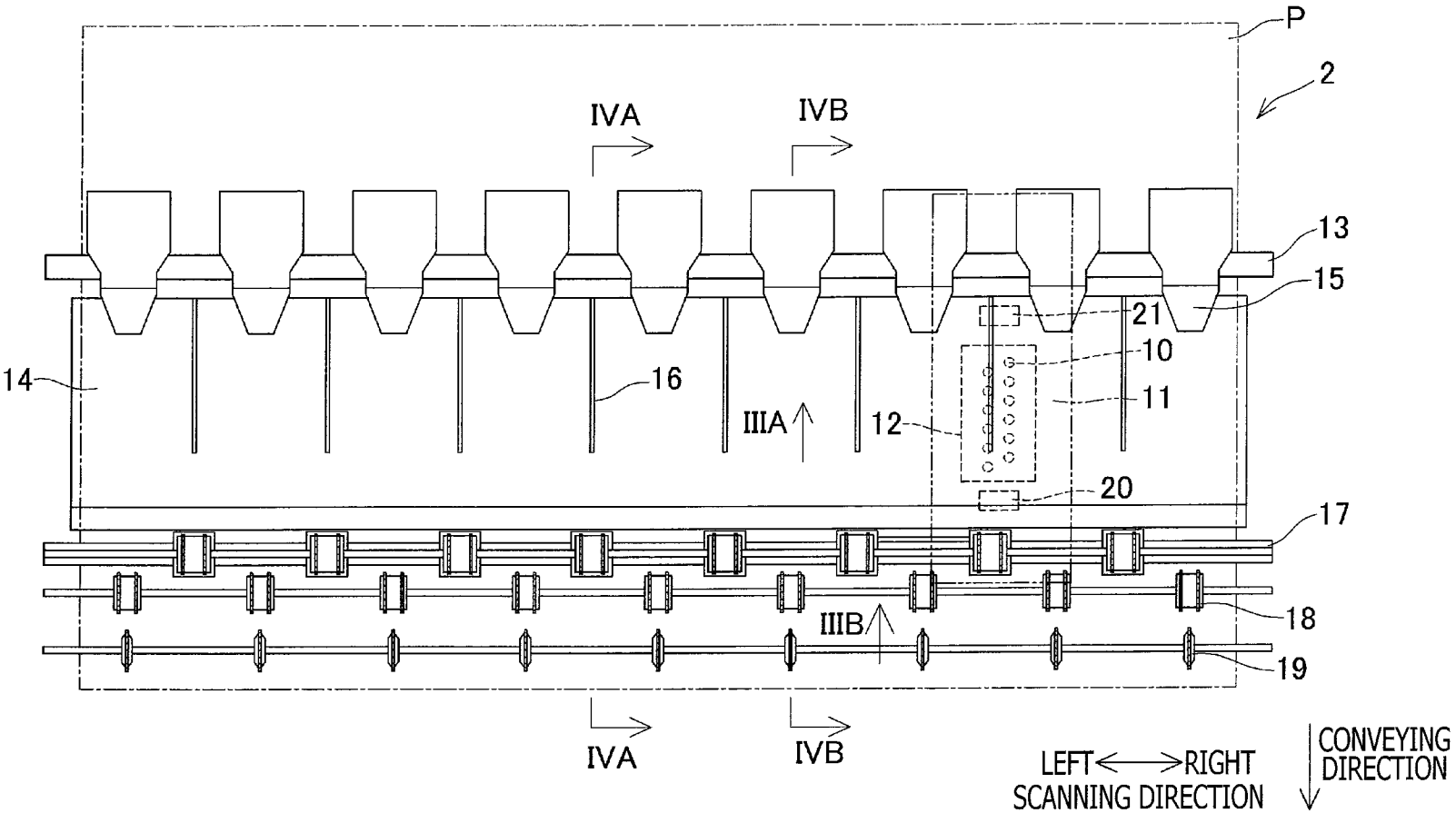
FIG. 2 is a plan view of a recording unit of the inkjet printer according to the embodiment.

An inkjet printer 1 according to an embodiment of the invention is an MFP (multi-function peripheral) which is capable of scanning an image formed on an original sheet, as well as recording images on a recording sheet (i.e., recording medium) P. According to the embodiment, the inkjet printer 1 has a recording unit 2 (see FIG. 2), a sheet supplying unit 3, a sheet discharging unit 4, a sheet scanning unit 5, an operation unit 6, and a display unit 7.

The recording unit 2 is provided inside the inkjet printer 1 and record an image on the recording sheet P. The sheet supplying unit 3 has a detachable sheet supply tray 3*a* which is configured to accommodate the recording sheets P, which are supplied therefrom to the recording unit 2 one by one when recording is executed. The sheet conveying unit 3 has a tray sensor 3*b* which is configured to detect whether the sheet supply tray 3*a* is attached or detached (see FIG. 5B). The sheet discharge unit 4 is a section on which the recording sheets P, on which recording by the recording unit 2 has already been executed, are discharged. The scanning unit 5 has a scanner function, and executes a scanning operation. The operation unit 6 has operation buttons and the like. The user input necessary information/commands through the operation unit 6 by operating the operation buttons of the operation unit 6. The display unit 7 is a liquid crystal display (LCD), and displays information necessary for a user when the user uses the inkjet printer 1 is being used.

The recording unit 2 has a carriage 11, an inkjet head 12, sheet supply rollers 13, a platen 14, a plurality of corrugate plates 15, a plurality of ribs 16, discharge rollers 17, a plurality of corrugated spurs 18 and 19 (see FIGS. 2-4B). It is noted that, in FIG. 2, the carriage 11 is indicated by two-dotted lines in FIG. 2 and components arranged below the carriage 11 are indicated by solid lines for clarifying the configuration.

The carriage 11 is driven by a carriage motor 41 and is moved reciprocally with being guided by guide rails (not shown) in a scanning direction. The inkjet head 12 is mounted on the carriage 11, and ejects the ink through a plurality of nozzles 10 formed on an ink ejection surface 12*a*. The sheet supply rollers 13 are a pair of rollers, which sandwiches the recording sheet P supplied by the sheet supply unit 3. The sheet supply rollers 13 are driven by the sheet conveying motor 44 (see FIG. 5) to rotate, and conveys the recording sheet P in a conveying direction which is perpendicular to the scanning direction. According to the embodiment, the sheet supply rollers 13 are arranged on an upstream, in the sheet conveying direction, with respect to the inkjet head 12. The platen 14 is arranged to face the ink ejection surface 12*a*. The recording sheet P conveyed by the sheet supply rollers 13 are conveyed along an upper surface of the platen 14.

The plurality of corrugate plates 14 are arranged to face the upper surface at an upstream end portion, in the sheet conveying direction, of the platen 14. The plurality of corrugate plates 15 are arranged substantially evenly in the scanning direction. The recording sheet P conveyed by the sheet supply rollers 13 proceeds between the platen 14 and the plurality of corrugate plates 15. When the recording sheet P passes, the corrugate plates 15 presses the recording sheet P with pressing surfaces 15*a*, which are lower surfaces of the plurality of corrugate plates 15, the plurality of corrugate plates 15 press the recording sheet P from the above. The plurality of ribs 16 are arranged on the upper plate of the platen at portions corresponding to spaces between, in the scanning direction, the corrugate plates 15. It is noted that the plurality of ribs 16 are substantially evenly arranged in the scanning direction. Each of the ribs 16 projects upward to a height which is higher than a plane of the pressing surfaces 15*a* of the corrugate plates 15. Further, the ribs 16 extend from an upstream, in the sheet conveying direction, end portion of the platen 14 to downward a downstream side in the sheet conveying direction. With the above configuration, the recording sheet P on the platen 14 is supported by the plurality of ribs 16 from below.

The discharge rollers 17 are a pair of rollers arranged on the downstream, in the sheet conveying direction, with respect to the inkjet head 12. The discharge rollers 17 sandwich the same portions, in the scanning direction, as the plurality of ribs 16. The discharge rollers 17 are driven by the conveying motor 44 (see FIG. 5) to rotate and convey the recording sheet P in the sheet conveying direction toward the discharge unit 4. Incidentally, the upper roller of the discharge rollers 17 is formed to be a spur roller so that the ink ejected on the recording sheet P may not adhere thereon. The plurality of corrugated spurs 18 are arranged on the downstream, in the sheet conveying direction, with respect to the discharge rollers 17, and at positions, in the scanning direction, substantially same as the corrugate plates 15. The plurality of corrugate spurs 19 are arranged on the downstream, in the sheet conveying direction, with respect to the corrugate spurs 18 at portions, in the scanning direction, substantially the same as the corrugate plates 15. The plurality of corrugated spurs 18 and 19 are arranged below a position, in the up-and-down direction, where the discharge rollers 17 sandwich the recording sheet P, press the recording sheet P from the above at this position. Since the corrugate spurs 18 and 19 are spur rollers, but not ones of which circumferential surfaces are cylindrical, the ink ejected on the recording sheet P hardly adhere thereon.

Figure 3A:
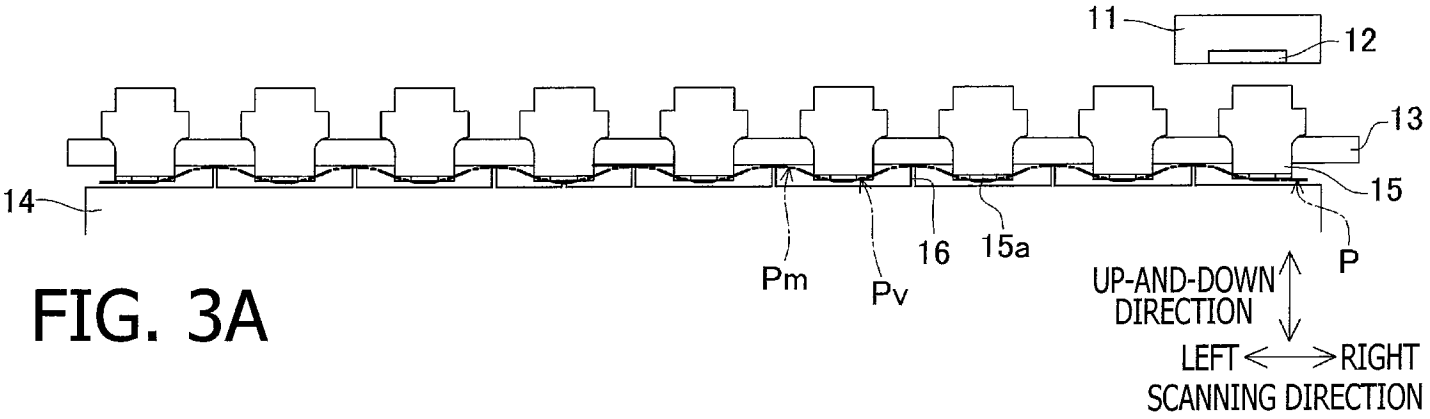
FIG. 3A is a cross-sectional view of the recording unit taken along line IIIA-IIIA of FIG. 2.
Figure 3B:
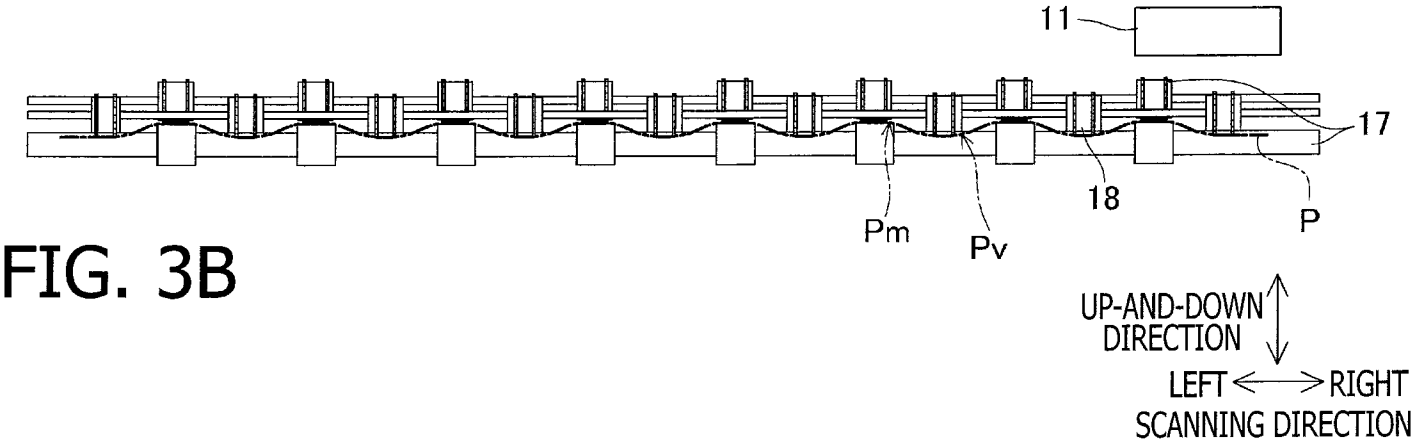
FIG. 3B is a cross-sectional view of the recording unit taken along line IIIB-IIIB of FIG. 2.
Figure 4A:
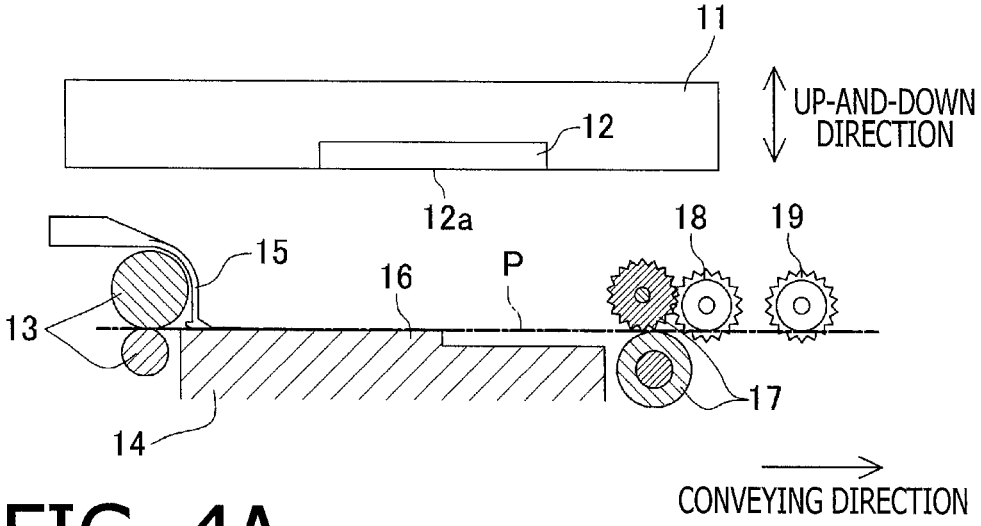
FIG. 4A is a cross-sectional view of the recording unit taken along line IVA-IVA of FIG. 2.
Figure 4B:
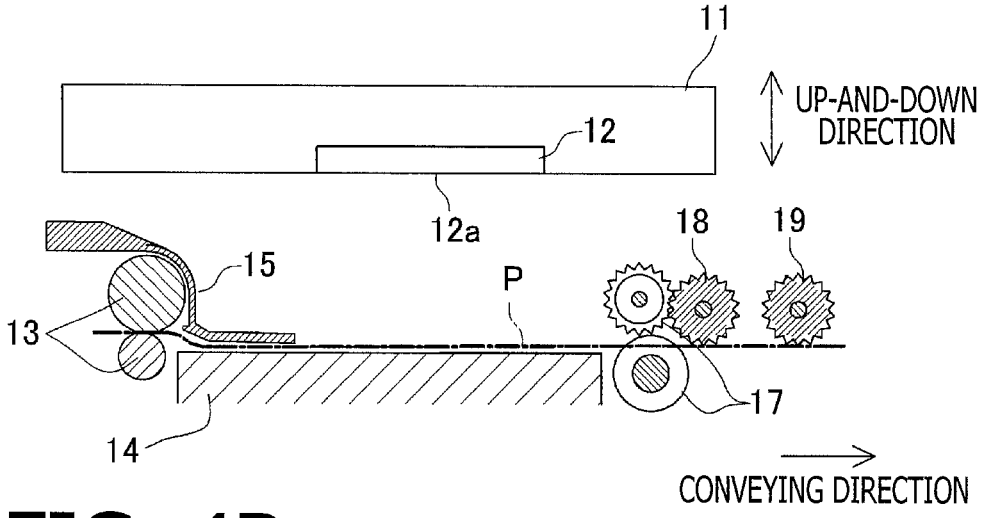
FIG. 4B is a cross-sectional view of the recording unit taken along line IVB-IVB of FIG. 2.

The recording sheet P on the platen 14 is pressed, by the plurality of corrugate plates 15 and the plurality of corrugate spurs 18 and 19 from the above, and supported by the plurality of ribs 16 from below. With this configuration, the recording sheet P is held, as shown in FIG. 3, to have alternately arranged eight ridge portions Pm protruded to be closer to the ink ejection surface 12*a* than an average height of the recording sheet P, and nine valley portions Pv recessed to farther from the ink ejection surface 12*a* than the average height of the recording sheet P. That is, the recording sheet P is held to have a corrugated shape. Specifically, the recording sheet P has a corrugated shape in cross-section taken along a plane extending in the scanning direction and perpendicular to the sheet conveying direction.

As described above, according to the embodiment, the corrugate plates 15, ribs 16 and the corrugate spurs 18 and 19 convey the recording sheet P with being held to have the corrugated shape. It is noted that, if the recording sheet P is of an expected type of sheet (e.g., a normal sheet), the recording sheet P is held to have the corrugated shape as described above. However, if the recording sheet P is of a type having relatively higher rigidity (e.g., an inkjet sheet, a coated sheet, etc.) than the normal sheet, the recording sheet P may not be sufficiently deformed in comparison with the normal sheet, and displaced amount in the up-and-down direction may be smaller than that of the normal sheet. In such a case, a part of the ridge portions Pm and/or the valley portions Pv may not be formed (i.e., the recording sheet P may not have the expected corrugated shape). Further, if the recording sheet P is of a type that has much higher rigidity (i.e., a glossy sheet) than the inkjet sheet or the coated sheet, the recording sheet P as held may hardly be deformed to have the corrugated shape, and may have substantially a planar shape.

An encoder sensor 20 is mounted on the carriage 11. The encoder sensor 20 is a linear encoder having an encoder strip (not shown) extending in the scanning direction, and configured to detect slits formed to the encoder strip and arranged in the scanning direction, thereby detecting the position of the inkjet head 12. A media sensor 21 is mounted on the carriage 11 and has a light emitting section 21*a* (see FIG. 5) to emit light toward the platen 14, and a light receiving section 21*b* (see FIG. 5) configured to receive light reflected by the platen 14 or the recording sheet P placed on the platen 14.

The media sensor 21 detects a leading edge of the recording sheet P which is conveyed by the sheet conveying rollers 13 when a printing operation is executed. Specifically, the platen 14 is black, and when the recording sheet P is conveyed by the sheet conveying rollers 13, the media sensor 21 emits light from the light emitting section 21*a* and receives the reflected light by the light receiving section 21*b*. When the media sensor 21 detects that the amount of the light received by the light receiving section 21*b* changed discontinuously, it is judged that the leading edge of the recording sheet P is detected. The media sensor 21 also detects, as described later, a length of the recording sheet P in the scanning direction and relative displacement amount E representing relative relationship of heights H of respective portions of the recording sheet P in addition to detection of the leading edge of the recording sheet P.

The recording unit 2 configures as above records images on the recording sheet P by conveying the recording sheet P in the sheet conveying direction with the sheet conveying rollers 13 and discharge rollers 17, and controls the inkjet head 12, which reciprocally moves together with the carriage 11, to eject ink drops on the recording sheet P.

Figure 5:
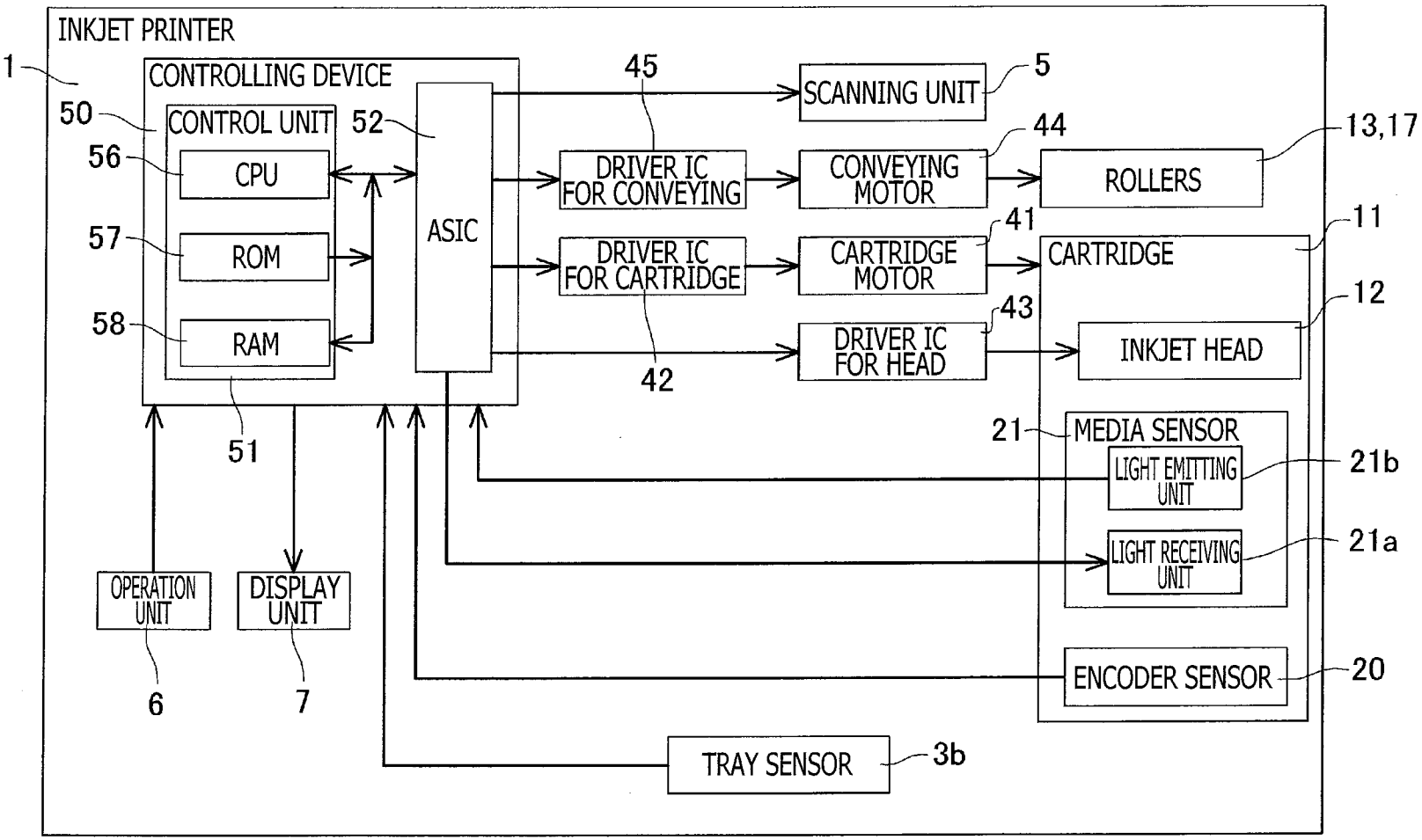
FIG. 5 is a block diagram illustrating a hardware configuration of the inkjet printer according to the embodiment of the invention.

A controlling device 50 has a control unit 51, an ASIC (Application Specific Integrated Circuit) 52 and the like as shown in FIG. 5. The control unit 51 includes a CPU (Central Processing Unit) 56, a ROM (Read Only Memory) 57, a RAM (Random Access Memory) 58 and the like which are interconnected through a bus. The CPU 52 transmits commands to the ASIC 52 and the like in accordance with data values and control programs stored in the ROM 57 or RAM 58.

The ASIC 52 includes various control circuits such as a carriage driver IC 42 to move the carriage motor 41, a head driver IC 43 to drive the inkjet head 12, conveying motor drive IC 45 to drive the sheet conveying motor 44, and a circuit to drive the scanning unit 5. Commands from the control unit 51 causes the ASIC 52 to drive various parts of the inkjet printer 1 so that images can be recording on the recording sheet P.

Figure 6:
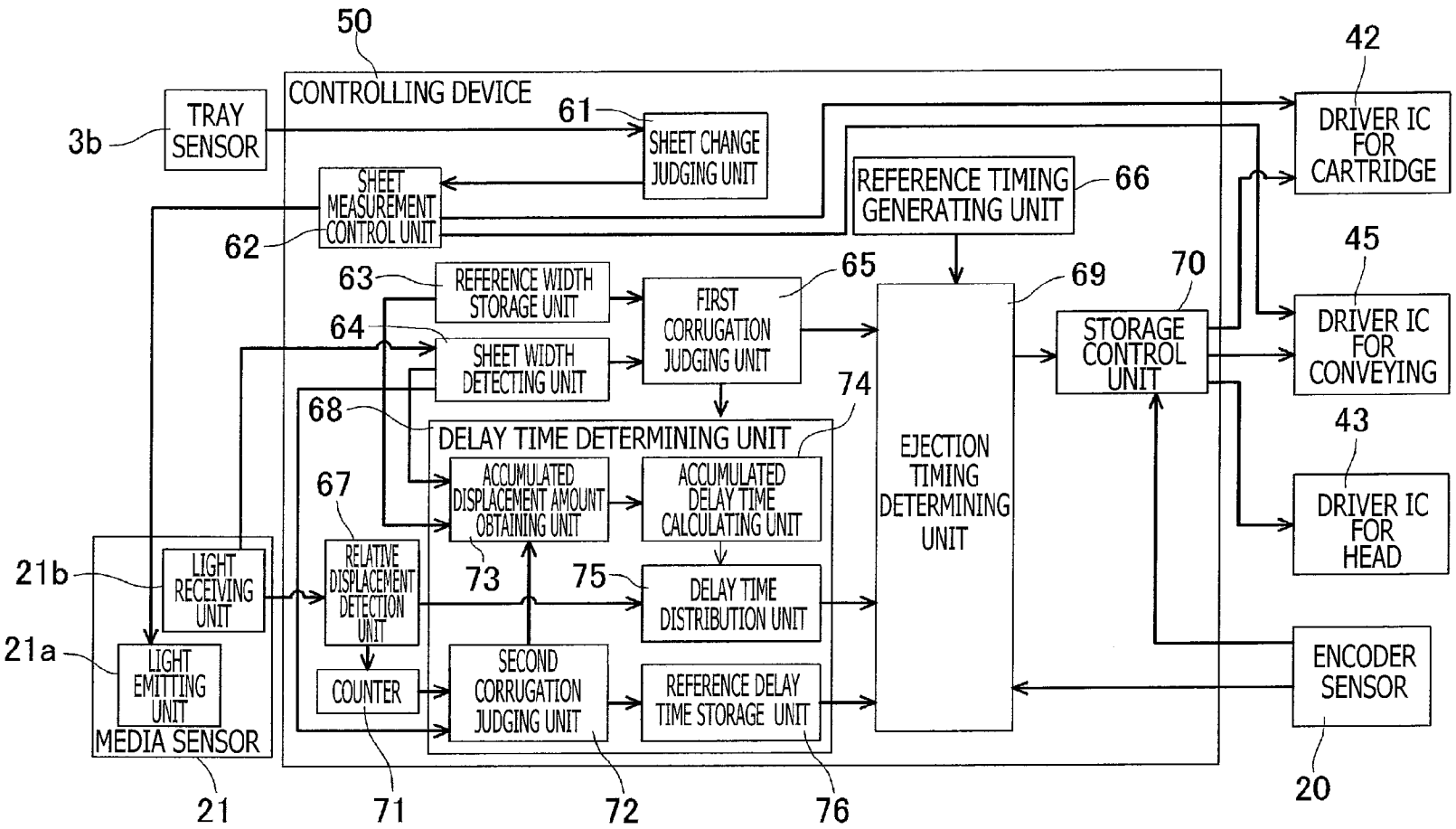
FIG. 6 is a functional block diagram illustrating a functional configuration of a control unit shown in FIG. 5.
Figure 9:
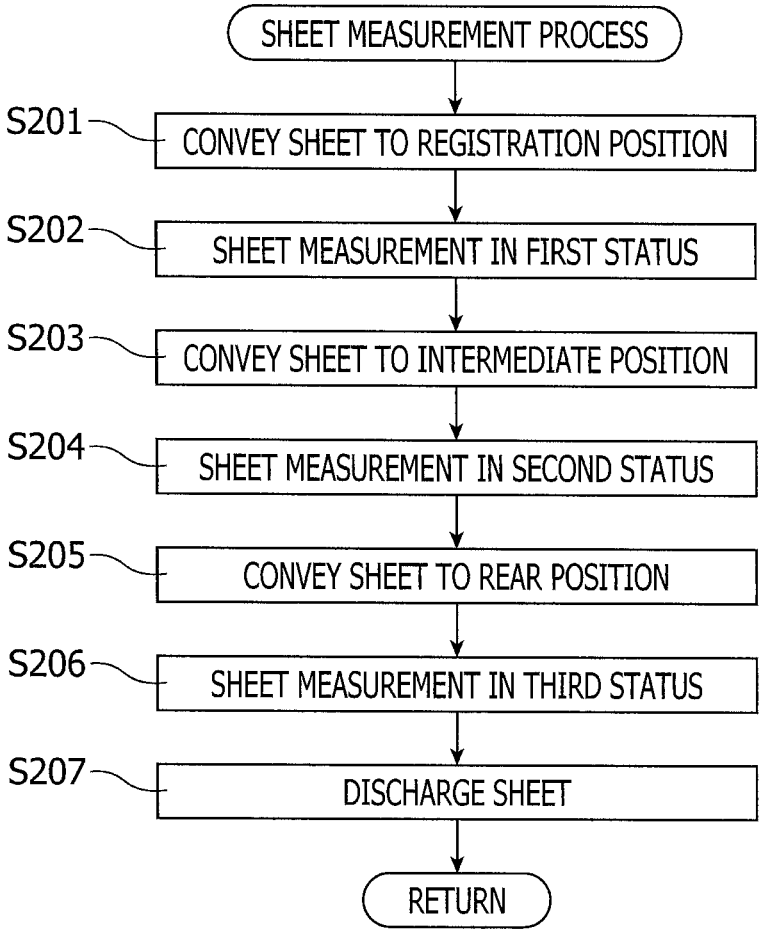
FIG. 9 is a flowchart illustrating a sheet measuring process executed by the control unit of the inkjet printer according to the embodiment of the invention.

According to the embodiment, the controlling device 50 is configured such that the control unit 41 and the ASIC 52 serve as a sheet change judging unit 61, a sheet measurement control unit 62, a reference width storage unit 63, a sheet width detecting unit 64, a first corrugated shape judging unit 65, a reference timing generating unit 66, a relative displacement detecting unit 67, a delay time determining unit 68, an ejection timing determining unit 69 and a recording control unit 70 as shown in FIG. 6.

The sheet change judging unit 61 judges whether the type of the recording sheet P accommodated in the sheet supply tray 3*a* has been changed based on a detection result of a tray sensor 3*b*. Specifically, when the tray sensor 3*b* detects removal of the sheet supply tray 3*a* and thereafter attachment of the sheet supply tray 3*a*, the sheet change judging unit 61 judges that the type of the recording sheet P accommodated in the sheet supply tray 3*a* has been changed. The sheet measurement control unit 62 controls movements of the media sensor 21 (i.e., the light emitting unit 21*a* and the light receiving unit 21*b*) and the carriage 11 when measurement of the width of the recording sheet P and the ridge portions Pm and the valley portions Pv are performed with use of the media sensor 21.

The reference width storage unit 63 stores the length L, in the scanning direction, of the recording sheet P for each type (e.g., the inkjet sheet, the coated sheet, the glossy sheet, etc.) at a non-corrugated state (i.e., when the recording sheet P is not held by the corrugate plates 15, ribs 16, corrugated spurs 18 and 19, and thus not deformed to be corrugated).

Specifically, the length L (when the recording sheet P is not corrugated) is a length defined in a standard for each type of the recording sheets P. The sheet width detecting unit 64 obtains an actual length (e.g., La, Lb or Lc, which are described later) in the scanning direction based on the detection result by the media sensor 21.

As described above, the platen 14 is black. When the media sensor 21 is moved, together with the carriage 11, in the scanning direction with emitting the light from the light emitting unit 21*a* and receiving the reflected light by the light receiving unit 21*b*, both side ends of the recording sheet P in the scanning direction can be known based on the positions of the media sensor 21 when the amount of light has changed discontinuously. The sheet width detecting unit 64 detects the length of the recording sheet P (i.e., a distance between both side ends) by calculating a difference between the two positions of the media sensor 21 when the light amount has changed discontinuously.

A first corrugated shape judging unit 65 judges whether the recoding sheet P on which images are to be formed is corrugated or not based on a difference ΔL which is a difference between the length L and the length La (Lb, or Lc). The recording sheet P held by the corrugate plates 15, ribs 16 and corrugated spurs 18 and 19 is deformed to have a corrugated shape, in the scanning direction, when the recording sheet P is the normal sheet, the inkjet sheet or the coated sheet although deformed amount or the number of the ridge portions Pm and the valley portions Pv may be different depending on the sheet type. In contrast, when the recording sheet P is the glossy sheet, it may be deformed little and thus has substantially a planar shape.

It would be known by comparing FIG. 7A and FIG. 7B that the length of the recording sheet P in the scanning direction is shortened when it is shaped to be corrugated. It should be noted that the more the amount of displacement of the recording sheet P in the up-and-down direction, the shorter the length, in the scanning direction, of the recording sheet P is. Therefore, the first corrugation judging unit 65 judges that the recording sheet P is deformed to have the corrugated shape when the difference ΔL between the length L and the length La (Lb, or Lc) is equal to or greater than a first predetermined difference F1, and is not deformed to be corrugated if the length L is less than the first predetermined difference F1.

The reference timing generating unit 66 generates a reference timing which represents an ejection timing of the ink from the nozzles 10 when the recording is executed on the recording sheet P which is not corrugated, based on image data or the like representing an image to be formed.

The relative displacement value detecting unit 67 detects a relative displacement value indicating a relative relationship of heights of respective parts of the recording sheet P with reference to a portion of the recoding sheet P farthest from the ink ejection surface 12*a* based on the detection results of the media sensor 21.

The amount of light the light receiving unit 21*b* receives is larger as the height of the recording sheet P is higher (i.e., the distance to the media sensor 21 is smaller). The relative displacement value detecting unit 67 detects values respectively corresponding to the light amount the light receiving unit 21*b* receives when the media sensor 21 faces various portions of the recording sheet P, and the lowest light among the lights the light receiving unit 21*b* receives, and detects the difference of the above values as the relative displacement value E.

Even if the height H of the recording sheet P is the same, the amount of light the light receiving unit 21*b* receives may be different for different types of the recoding sheet P. Therefore, the amount of light the light receiving unit 21*b* receives or the relative displacement value E does not have a one-to-one relationship with the height of the recording sheet H. However, depending on relationships among the relative displacement values E at respective positions on the recording sheet P, relative relationship among the heights H at respective positions on the recording sheet P can be known.

The delay time determining unit 68 has a counter 71, a second corrugation judging unit 72, an accumulated delay time calculating unit 74, a delay time distributing unit 75 and a standard delay time storage unit 76.

The counter 71 is configured to count the numbers of the ridges Pm and the valleys Pv of the recording sheet P held by the corrugate plates 15, ribs 16 and corrugated spurs 18 and 19. Specifically, the counter 71 may count the number of local maximum values of the relative displacement values E detected by the relative displacement value detecting unit 67 to detect the number of the ridge portions Pm, while the counter 71 also counts the number of local minimum values of the relative displacement values E to detect the number of the valley portions Pv.

The second corrugation judging unit 72 judges whether the recording sheet P is deformed to have the predetermined corrugated shape. Specifically, when the recoding sheet P is the normal sheet, the recoding sheet P held by the corrugate plates 15, the ribs 16 and the corrugate spurs 18 and 19 has the predetermined corrugated shape, which is defined to have alternately arranged eight ridge portions Pm and nine valley portions Pv as shown in FIG. 3 and FIG. 7B. Further, the difference ΔL is equal to or greater than the second predetermined difference F2 which is greater than the first predetermined difference F1. In contrast, when the recording sheet P is a sheet having a relatively higher rigidity than the normal sheet, the recoding sheet P held by the corrugate plates 15, the ribs 16 and the corrugate spurs 18 and 19 may not be curved so greatly in comparison with the normal sheet. Therefore, when the relatively rigid sheet is used, a part of the eight ridge portions Pm and the nine valley portions Pv may not be formed and/or the difference ΔL may be smaller than the second predetermined difference F2.

Therefore, according to the embodiment, when the difference ΔL is smaller than the second predetermined difference, and the numbers of the ridge portions Pm and the valley portions Pv counted by the counter 71 are eight and nine, respectively, the second corrugation judging unit 72 judges that the recoding sheet P is formed to have the predetermined corrugated shape. If, however, the difference ΔL is smaller than the second predetermined difference F2, if the number of the ridge portions Pm counted by the counter 71 is less than eight or if the number of the valley portions Pv is less than nine, the second corrugation judging unit 72 judges that the recoding sheet P is not deformed to have the corrugated shape.

The accumulated displace amount obtaining section 73 obtains accumulated displacement amount representing the accumulated heights H of the respective portions of the recoding sheet P based on the length L of the recording sheet P stored in the reference width storage unit 63, and the length La (Lb or Lc) of the recording sheet P detected by the sheet length detecting unit 64. The accumulated displace amount is, according to another aspect, an accumulation of downward displacement amount of respective portions of the recording sheet P with reference to a portion (of the recording sheet P) closest to the ink ejection surface 12*a*.

The accumulated delay time determining unit 74 calculates an accumulated delay time by accumulating the delay time for each ejection timing of the ink reaches each portion of the recording sheet P based on the accumulated displace amount obtained by the accumulated displace amount obtaining unit 73. The delay time distribution unit 75 distributes the accumulated delay time calculated by the accumulated delay timing calculating unit 74 to the ejection timings of the ink reaching respective portions on the recording sheet P based on the relative displacement values E detected by the relative displacement value detecting unit 67. Distribution of the ejection timings will be described in detail later. The standard delay time storage unit 76 stores a standard delay time which is a delay time when the recording sheet P has the predetermined corrugated shape.

The ejection timing determining unit 69 determines the ejection timing of the ink at each nozzle when the recording is executed. Determination of the ejection timing will also be described later. The recording control unit 70 controls operation of the carriage driver IC 42, the head driver IC 43, and the sheet convey driver IC 45 and the like when the recording is executed. Specifically, the recording control unit 70 controls the operation of the carriage driver IC 42, the head driver IC 43 so that the ejection timings of the ink drops which reach the respective portions of the recording sheet P become equal to the ejection timings determined by the ejection timing determining unit 69.

According to the embodiment, the reference width storage unit 63 and the standard delay time storage unit 76 are realized by the RAM 58 of the control unit 51 and the like. The sheet change detecting unit 61, the sheet measurement control unit 62, the sheet width detecting unit 64, the first corrugation judging unit 65, the reference timing generation unit 66, the relative displacement value detecting unit 67, the ejection timing determining unit 69, the recording control unit 70, the counter 71, the second corrugation judgment unit 72, the accumulated displacement determining unit 73, the accumulated delay time calculating unit 74 and the delay time distribution unit 75 are realized by the control unit 51 (CPU 56, ROM 57 and RAM 58) and ASIC 52. Alternately, these may be realized only by the control unit 51, or only by the ASIC 52.

When the recording images on the recording sheet P with the recording unit 2, the sheet change judging unit 61 judges whether the sheet supply tray 3*a* has been removed and re-attached to the inkjet printer 1 (S101 in FIG. 8). If the removal/re-attachment of the sheet supply tray 3*a* has not been done (S191: NO), the control unit 51 executes the recording process (see S104). If the sheet supply tray 3*a* has been removed and re-attached (S101: YES), the control unit 51 executes the sheet measurement process (S102) and the compensation amount determining process (S103) before executing the recording process (S104).

Figure 10A:
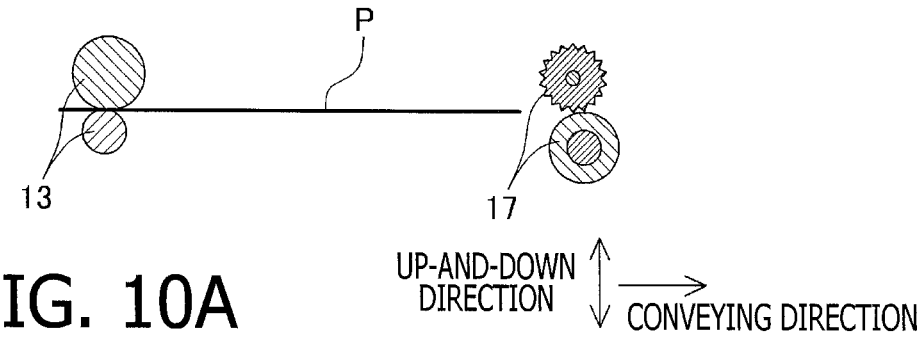
FIGS. 10A-10C show changes of the status of the sheet as conveyed.

In the sheet measurement process in S102, the recording sheet P is conveyed at a predetermined position (hereinafter, referred to as a front position) at which the recording sheet P is sandwiched by the sheet supply rollers 13, while the recording sheet P is not sandwiched by the discharge rollers 23 as shown in FIG. 10A under control of the sheet measurement control unit 62 (S201). This status of the recording sheet P will be referred to as a first status. Under this state, with use of the media sensor 21, the sheet width detecting unit 64 and the relative displacement value detecting unit 67, the length La of the recording sheet P in the scanning direction, and relative displacement values E at respective points of the recording sheet P (S202).

Figure 10B:
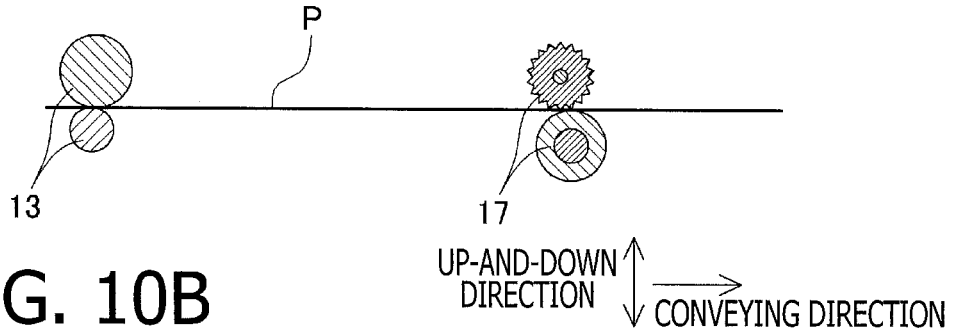

Next, the recording sheet P is conveyed at another predetermined position (hereinafter, referred to as an intermediate position) at which the recording sheet P is sandwiched by both the sheet supply rollers 13 and the discharge rollers 17 as shown in FIG. 10B under control of the sheet measurement control unit 62 (S203). This status of the recording sheet P will be referred to as a second status. Under this state, similar to S201, with use of the media sensor 21, the sheet width detecting unit 64 and the relative displacement value detecting unit 67, the length Lb of the recording sheet P in the scanning direction, and relative displacement values E at respective points of the recording sheet P (S204).

Figure 10C:
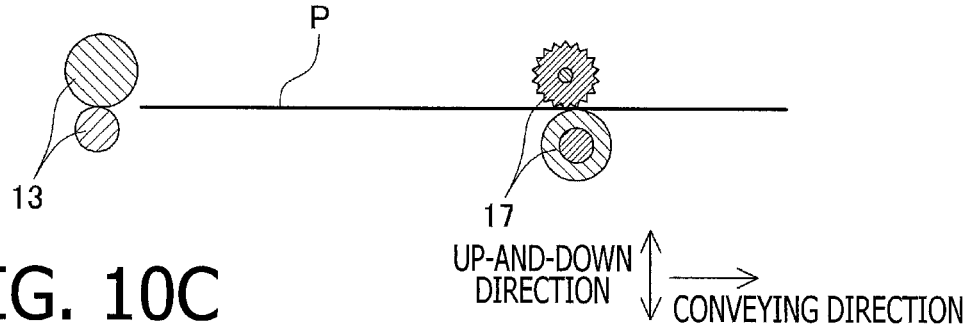

Next, the recording sheet P is conveyed at another predetermined position (hereinafter, referred to as a rear position) at which the recording sheet P is not sandwiched by the sheet supply rollers 13 but sandwiched by the discharge rollers 17 as shown in FIG. 10C (S205). This status of the recording sheet P will be referred to as a third status. Under this status, similar to S202, the length Lc of the recording sheet P in the scanning direction and relative displacement values E at respective portions of the recording sheet P will be measured (S206). After execution of S206, the recording sheet P as used is discharged (S207), and the controlling device 50 returns to the flowchart shown in FIG. 8. It is noted that the lengths La, Lb and Lc, and the relative displacement values E measured in S202, S204 and S206 are stored in, for example, the RAM of the controlling device 50.

Figure 11A:
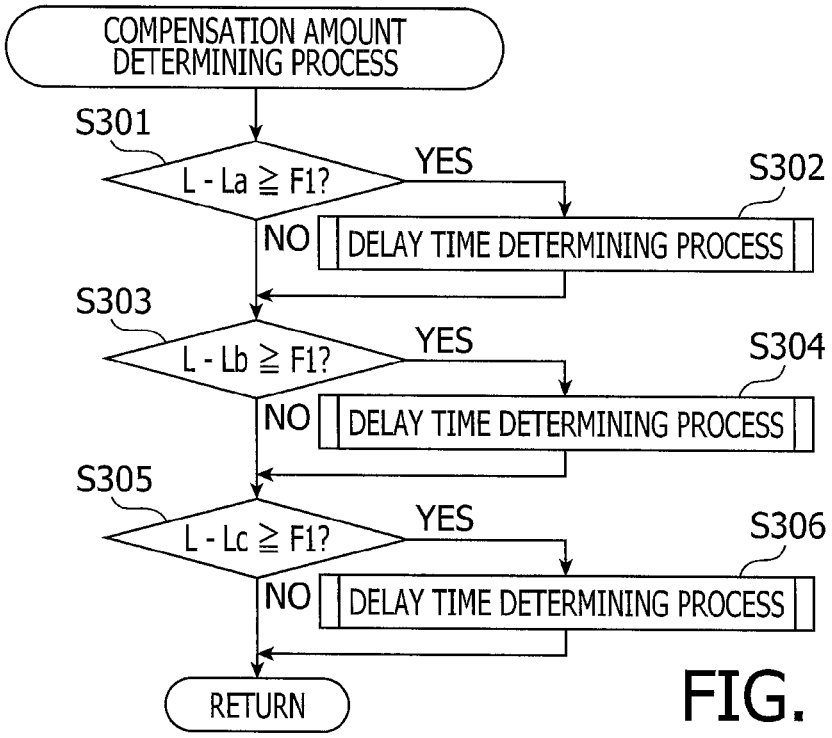
FIG. 11A is a flowchart illustrating a compensation amount determining process which is called in the process shown in FIG. 8.

In the compensation amount determination process in S103, as shown in FIG. 11A, the first corrugation judging unit 65 judges whether a difference between the length L of the recording sheet P in the scanning direction and stored in the reference width storage unit 63 and the length La measured in S202 is equal to or greater than the first predetermined difference F1 (S301). If the difference (L-La) is less than the first predetermined difference F1 (S301: NO), the first corrugation judging unit 65 judges that the recording sheet P under the first status does not have the corrugated shape and the process proceeds to S303. If the difference (L-La) is equal to or greater than the first predetermined difference F1 (S301: YES), it is judged that the recording sheet P in the first status has the corrugated shape and the process proceeds to S303 after executing the delay time determination process in the first status (S302).

In S303, the first corrugation judging unit 65 judges whether a difference between the length L of the recording sheet P in the scanning direction and stored in the reference width storage unit 63 and the length Lb measured in S204 is equal to or greater than the first predetermined difference F1. If the difference (L-Lb) is less than the first predetermined difference F1 (S303: NO), the first corrugation judging unit 65 judges that the recording sheet P under the second status does not have the corrugated shape and the process proceeds to S305. If the difference (L-Lb) is equal to or greater than the first predetermined difference F1 (S303: YES), it is judged that the recording sheet P in the second status has the corrugated shape and the process proceeds to S305 after executing the delay time determination process in the second status (S304).

In S305, the first corrugation judging unit 65 judges whether a difference between the length L of the recording sheet P in the scanning direction and stored in the reference width storage unit 63 and the length Lc measured in S206 is equal to or greater than the first predetermined difference F1. If the difference (L-Lc) is less than the first predetermined difference F1 (S305: NO), the first corrugation judging unit 65 judges that the recording sheet P under the third status does not have the corrugated shape and the process returns to the flowchart shown in FIG. 8. If the difference (L-Lc) is equal to or greater than the first predetermined difference F1 (S305: YES), it is judged that the recording sheet P in the third status has the corrugated shape and the process returns to the flowchart shown in FIG. 8 after executing the delay time determination process in the third status (S306).

Figure 11B:
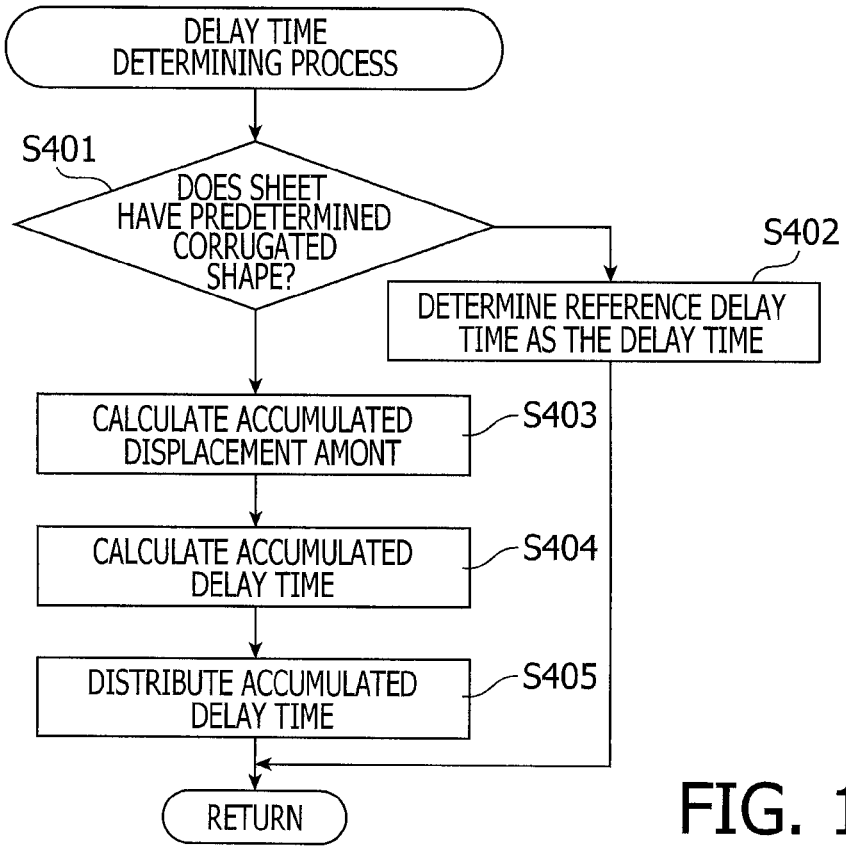
FIG. 11B is a flowchart illustrating a delay time determining process which is called in the process shown in FIG. 11A.
Figure 12:
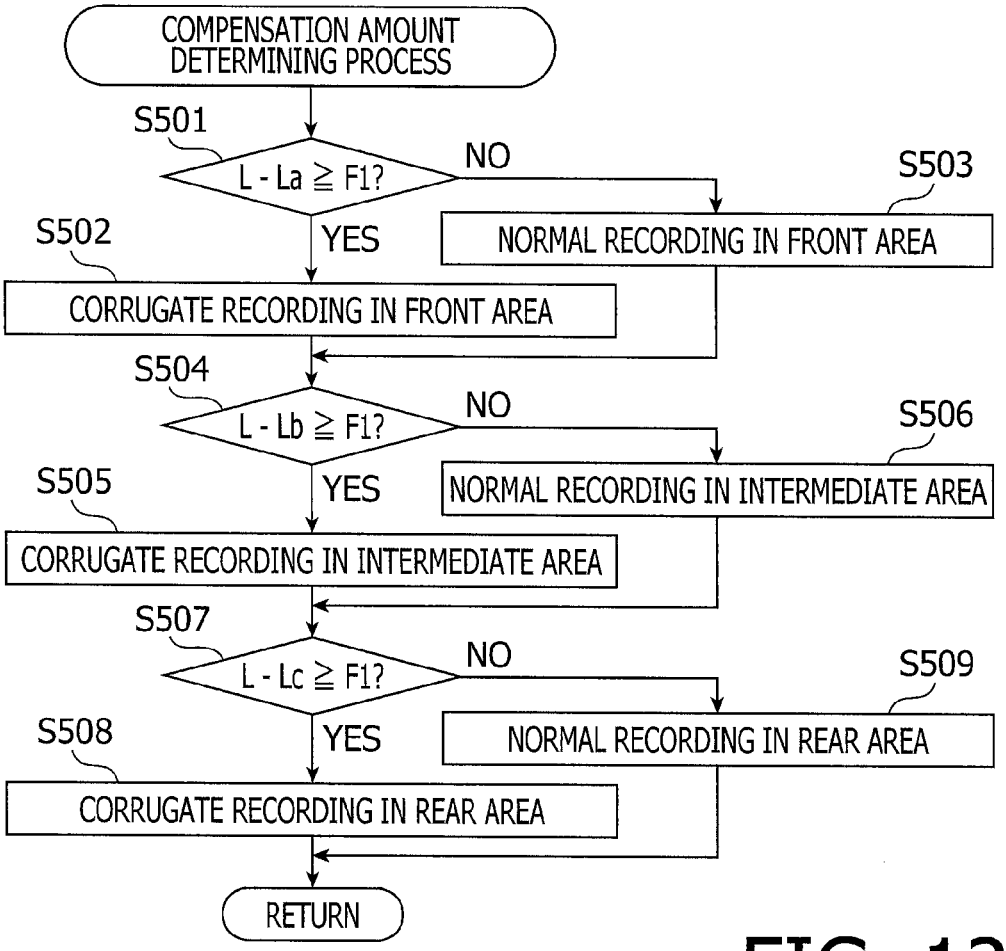
FIG. 12 is a flowchart illustrating a recording process which is called in the process shown in FIG. 8.

In the delay time determination process in S302, S304 and S306, the second corrugation judging unit 72 judges whether the recording sheet P has the predetermined corrugated shape (S401) as shown in FIG. 11B. If it is judged that the recording sheet P has the predetermined corrugates shape (S401: YES), the standard delay time stored in the standard delay time storage unit 76 is determined to be used as the delay time (S402) and the process returns to the flowchart shown in FIG. 8.

If it is judged that the recording sheet P has the corrugated shape but it is not the predetermined corrugated shape, the accumulated displacement amount obtaining unit 73 calculates an accumulated displacement amount (S403), and the accumulated delay time calculating unit 74 calculates a accumulated delay time Dt based on the accumulated displacement amount (S404). Then, the delay time distribution unit 75 distributes the accumulated delay time to ejection timings of the ink drops which reach the respective portions on the recording sheet P (S405). At this stage, for example, the delay time D is calculated in accordance with a formula:

$$D=Dt\times(E/S)$$

where, E is the relative displacement values at respective portions of the recording sheet P, and S is the accumulated value, which is obtained by accumulating the relative displacement values E. That is, in S405, the delay time distributed to the portion which is farthest from the ink ejection surface 12*a* is set to zero, and a longer delay time is distributed to the ejection timing for ejecting the ink to a portion of the recording sheet P closer to the ink ejection surface 12*a*. After execution of S405, the process returns to the flowchart shown in FIG. 8.

In the recording process at S104, if the difference of the lengths (L-La) is smaller than the first predetermined difference F1 (S501: NO), the ejection timing determining unit 69 determines the standard ejection timing as the ink ejection timing to be used, ejects the ink from the nozzles 10 at the determined ejection timings, so that on an area (hereinafter, referred to a front area) facing the ink ejection surface 12*a* when the recording sheet is conveyed under the first status (S502: normal recording).

If the difference of the lengths (L-La) is equal to or greater than the first predetermined difference F1 (S501: YES), the ejection timing determining unit 69 determines timings, which is are delayed timings by delaying the standard ejection timing by the delay times (i.e., the standard delay time or delay times distributed in S405), which are determined by the delay time determining process at S302, as the ejection timings, ejects the ink through the nozzles 10 in accordance with the determined timings to record an image on the front area of the recording sheet P (S503: corrugate recording).

Following the normal recording in S502 or the corrugate recording in S503, if the difference between the lengths (L-Lb) is less than the first predetermined difference F1 (S504: NO), the ejection timing determination unit 69 determines the reference ejection timing as the ejection timing to be used, and ejects the ink from the nozzles 10 in accordance with the determined ejection timing, thereby recording being executed on an area (hereinafter, referred to as an intermediate area) facing the ink ejection surface 12 when the recording sheet P is conveyed in the second status (S505: normal recording). If the difference of length (L−Lb) is equal to or greater than the first predetermined difference F1 (S504: YES), the ejection timing determining unit 69 determines a timing which is the reference timing delayed by the delay time calculated in the delay time determining process (S304) as the ejection timing of the ink to be used, and the ink is ejected from the nozzle 10 at the thus determined ejection timing, thereby recording is executed with respect to the intermediate area of the recording sheet (S506: corrugate recording).

Following the normal recording in S505 or the corrugate recording in S506, if the difference between the lengths (L-Lc) is less than the first predetermined difference F1 (S507: NO), the ejection timing determination unit 69 determines the reference ejection timing as the ejection timing to be used, and ejects the ink from the nozzles 10 in accordance with the determined ejection timing, thereby recording being executed on an area (hereinafter, referred to as a rear area) facing the ink ejection surface 12 when the recording sheet P is conveyed in the third status (S508: normal recording). If the difference of length (L-Lc) is equal to or greater than the first predetermined difference F1 (S507: YES), the ejection timing determining unit 69 determines a timing which is the reference timing delayed by the delay time calculated in the delay time determining process (S304) as the ejection timing of the ink to be used, and the ink is ejected from the nozzle 10 at the thus determined ejection timing, thereby recording is executed with respect to the intermediate area of the recording sheet (S509: corrugate recording). Thereafter, the process returns to the flowchart shown in FIG. 8.

According to the exemplary embodiment, if a difference between the length L of the recording sheet P when it does not have the corrugated shape and the actually measured length La (Lb or Lc) is equal to or greater than the first predetermined difference F1, it is judged that the recording sheet P has the corrugated shape, while, if the difference is less than the first predetermined difference F1, it is determined that the recording sheet P does not have the corrugated shape. When the recording sheet P is judged not to have the corrugated shape, the recording is executed by ejecting the ink from the nozzles 10 at the reference timing. If the recoding sheet P is judged to have the corrugated shape, the delay time is determined, and the ink is ejected from the nozzle 10 at a timing which is delayed from the reference timing by the determined delayed time. With this configuration, even if the type of the recording sheet P is changed, the ink drops can reach appropriate positions on the recording sheet P regardless whether the recording sheet has the corrugated shape, or regardless of an degree of corrugation of the recording sheet P when it is corrugated.

If the recording sheet P is judged to have the corrugated shape, if it is further judged that the recording sheet P has the predetermined corrugated shape, the standard delay time is determined to be used as the delay time. On the other hand, if the recording sheet P is judged to have the corrugated shape but is not judged to have the predetermined corrugated shape, the accumulated displace amount is calculated based on the lengths L, La, Lb and Lc, the accumulated delay time is calculated based on the accumulated displace amount, then the calculated accumulated delay time is distributed depending on the positions of the ridge portions Pm and the valley portions Pv of the recording sheet P to determine the delay time to be actually used. According to this configuration, the delay time is appropriately determined based on the degree of corrugation of the corrugated recording sheet P, and the ink drops can reach the appropriate positions on the recording sheet P.

If the recoding sheet P has the predetermined corrugated shape, the standard delay time is determined to be used as the delay time. Therefore, in such a case, processes of calculating the accumulated delay time, and determining the delay time by distributing the calculated delay time can be avoided, and the delay time can be determined simply. Further, when the delay time is determined by distributing the accumulated delay time, since the accumulated displacement amount, which is necessary to calculate the accumulated delay time, is obtained based on the difference between the length L and the measured lengths La, Lb and Lc, extra sensors to precisely detect the heights of respective portions of the recording sheet P will not be required, according to the exemplary embodiment.

According to the exemplary embodiment, the delay time is determined such that the delay time for the ejection timing of the ink drop that reaches a portion of the recording sheet P farthest from the ink ejection surface 12*a* is zero. Therefore, the delay time can be minimized. With this configuration, it is possible to avoid or suppress a case where a delay time for an ejection timing becomes too long which makes the current ejection timing later than the subsequent ejection timing, thereby preventing the nozzle 10 from ejecting the ink at appropriate timings.

It is noted that even though the recording sheet P is of the same type, depending on which of the first through third states the recording sheet P is currently in, the recording sheet P may or may not be corrugated, or the corrugated shape may vary. According to the exemplary embodiment, the length of the recording sheet P in the scanning direction is measure and the relative displacement values at various portions of the recording sheet P are measured, and the ejection timings are determined based on the measurement results (hereinafter, these are referred to as a measurement of the recording sheet P and determination of the ejection timing). Therefore, the ink drops can reach appropriate positions on the recording sheet.

When the sheet supply tray 3*a* is removed/attached, there is a possibility that the recording sheet P has been exchanged. According to the exemplary embodiment, when the sheet supply tray 3*a* has been removed and attached after the previous recording, the measurement of the recording sheet P and determination of the ejection timing are executed. Therefore, even if the recording sheet P has been exchanged, the ink is ejected from the nozzles 10 at appropriate timings corresponding to the used recoding sheet P, and the ink drops reach appropriate positions on the recording sheet P.

Configured as above, when the sheet supply tray 3*a* is removed/attached in order to supplement the same recording sheet P, the measurement of the recording sheet P and the determination of the ejection timing are executed unnecessarily. However, the measurement of the recording sheet P and the determination of the ejection timing are executed without requiring a particular operation by the user, it is ensured that the ink is ejected at the appropriate timing when the recording is executed, and the ink drops reach appropriate positions on the recording sheet P.

It is noted that the length of the recording sheet when it is not corrugated is the length of the sheet defined by a standard in association with the size of the sheet when the sheet is not corrugated.

According to the exemplary embodiment, regardless whether the type of the recording sheet P has been changed, whether the recording sheet P is corrugated and the degree of corrugation, whether corrugated shape is different depending on a portion of the sheet or conveyed state of the sheet, the ejection timing can be determined appropriately (i.e., suitable to the current condition of the recording sheet P), and the ink can be made to reach appropriate portions on the recording sheet P.

Next, modifications of the exemplary embodiment will be described. In the following description, components same as those of the exemplary embodiment will be assigned to similar reference numerals and description thereof will be simplified or omitted for brevity.

Figure 13:
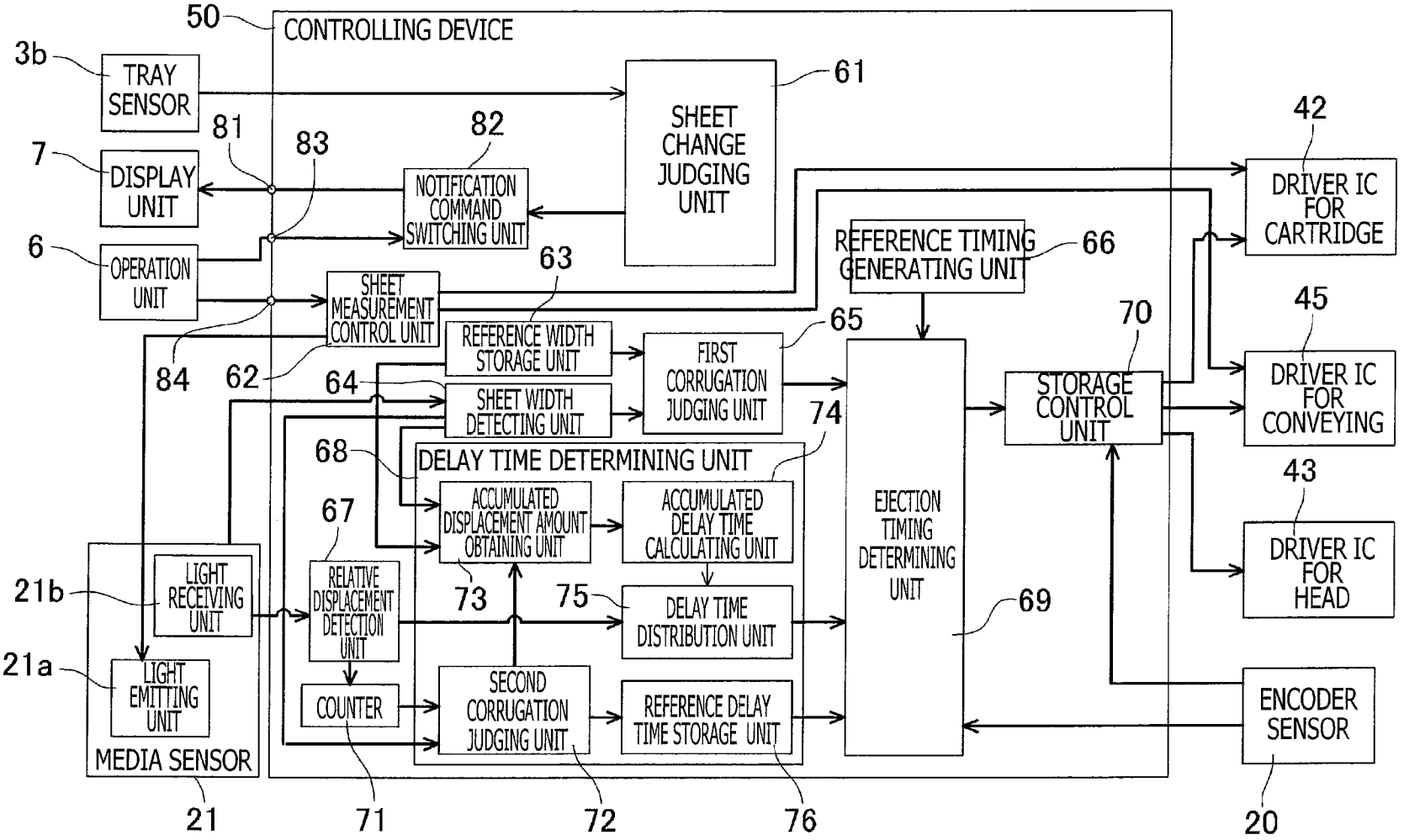
FIG. 13 is functional block diagram illustrating a functional configuration of the control unit according to a modified embodiment.

In the exemplary embodiment, when the sheet supply tray 3*a* has been removed and attached after the previous recording, the measurement of the recoding sheet P and the determination of the ejection timings are always executed. The invention should not be limited to such a configuration. In one modification, as shown in FIG. 13, the controlling device 50 may further function as a notification command transmitting unit 81, a notification command switching unit 82, a switching command signal receiving unit 83 and a determined command signal receiving unit 84.

The notification command signal transmitting unit 81 is configured to transmit a notification command which instructs to notify that the type of the recording sheet P has been changed. The notification command signal transmitting unit 81 is connected to the display unit 7. The sheet change judging unit 61 transmits a notification signal to the notification command signal transmitting unit 81 when detecting that the type of the recording sheet P has been changed. When the display unit 7 receives the notification command signal transmitted by the notification command signal transmitting unit 81, the display unit 7 displays messages notifying the type of the recording sheet P may have been changed.

The notification command switching unit 82 switches transmission of the notification command signal from the sheet change judging unit 61 between a transmitting state and a non-transmitting state. The switching command signal receiving unit 83 receives the switching command signal that instructs the switching of the transmission of notification command. The switching command signal receiving unit 83 is configured to receive the switching command signal.

The determination command signal receiving unit 84 is configured to receive a determining command signal, which instructs to determine the measurement of the recording sheet P and the ejection timing, transmitted from the operation unit 6 in accordance with a user's operation by a user who has reviewed the message contained in the notification. The determining command signal received by the determination command signal receiving unit 84 is transmitted to the sheet measurement control unit 62. When the sheet measurement control unit 62 receives the determination command signal, as in the exemplary embodiment, the measurement of the recording sheet P and the determination of the ejection timing are executed.

In this case, even if the sheet supply tray 3*a* has been removed/attached after the previous recording, only when the user has operated the operation unit 6, the measurement of the recording sheet P and the determination of the ejection timing are executed. Therefore, in a case, for example, where the same type of the recording sheet P are complimented, the measurement of the recording sheet P and the determination of the ejection timing can be prevented from unnecessarily executed.

Further, according to the modification, it is possible that transmission of the notification command signal from the notification command signal transmitting unit 81 to the display unit 7 can be switched on or off. Therefore when the user recognizes that the type of the recording sheet P is always the same, user may set that the notification command signal is not transmitted from the notification command signal transmission unit 81 to the display unit 7, thereby it is possible to prevent that a message is displayed every time when the recording sheet P is complimented to the sheet supply tray 3*a*.

According to the modification, where the notification command signal transmission unit 81 transmits the notification command signal to the display device 7 or not can be switched. Therefore, it may be configured that, if the switching operation cannot be done and the sheet supply tray 3*a* has been removed/attached, the notification command signal is always transmitted from the notification command signal transmitting unit 31 to the display unit 7.

According to the modification, the switch command signal receiving unit 83 and the determination command signal receiving unit 84 are connected to the display unit 7 of the PC, and the notification command signal transmission unit 81 is connected to the display unit 7. It is noted that the invention needs not be limited to such configuration, but may be configured such that the notification command signal transmission unit 81, the switching command signal receiving unit 83, and the determination command signal receiving unit 83 may be connected to an external PC, which is distinct from the inkjet printer 1, the message is displayed on the PC, and upon user operation of the PC, the switching command signal and/or the determination command signal may be received.

According to the exemplary embodiment, by detecting removal/attachment of the sheet supply tray 3*a*, whether the type of the recoding sheet P has been changed or not is judged. However, the invention need not be limited to such a configuration. For example, an additional sensor dedicated to detect the type of the recording sheet P may be provided, and decision may be made based on detection by such a sensor. Alternatively, such a judgment may not be executed. For example, the measurement of the recording sheet P and the determination of the ejection timing may be made only when a user inputs a command by operating the operation unit 6.

According to the exemplary embodiment, the measurement of the recording sheet P and the determination of the ejection timing are executed for each of the first, second and third state of the recording sheet P. However, if there will no significant difference in the shape of the recording sheet P, the measurement of the recording sheet P and the determination of the ejection timing may be executed for one or two of the first, second and third states.

According to the exemplary embodiment, the relative displacement amount detecting unit 67 detects the relative displacement value E indicating the relative relationship of the heights H of respective portions. However, the invention needs not be limited to such a configuration. For example, the relative displacement amount detecting unit 67 may be configured to detect the relative displacement value E indicating the relative relationship of downward displaced amounts of respective portions. In such a case, similar to S405, by distributing the accumulated delay time in accordance with the relative displacement amounts of respective portions of the recording sheet P, the ejection timing can be determined appropriately.

According to the exemplary embodiment, the delay time with respect to the reference timing is determined as a compensation value of the ejection timing from the nozzle 10. Further, the delay times are determined such that the delay time corresponding to the ink drop which reaches the farthest portion, which is the farthest from the ink ejection surface 12*a*, of the recording sheet P is determined to be zero. Such a determination is only an example, and the delay times can be determined in different ways. For example, the delay times may be determined such that the delay time corresponding to the ink drop which reaches the farthest portion of the recording sheet P is determined to have a value greater than zero. Further, the compensation amounts need not be the delay times. If possible, the compensation values may ones with which the reference timing is made earlier.

In the exemplary embodiment, when the recording sheet P is deformed to have the predetermined corrugated shape, the standard delay time stored in the standard delay time storage unit 76 is determined to be the delay time to be used, and the ejection timing determining unit 69 determines the ejection timings based on the thus determined delay time. It is noted that the invention need not be limited to such a configuration. For example, in the RAM which is used as the standard delay time storage unit 78, a delayed standard timing, which is defined as a timing delaying the standard timing by a standard delay time, may be stored, and the thus stored delayed standard timing may be used when the recoding sheet P has the predetermined corrugated shape. Alternatively, the standard delay time or the delayed standard timing may not be used. That is, when it is judged that the recording sheet P has a corrugated shape, the delay time is calculated in accordance with steps S403-S405 regardless whether the corrugated shape is the predetermined one or not.

According to the exemplary embodiment, when it is judged that the recording sheet P has a corrugated shape, it is further judged that whether the recording sheet P has the predetermined corrugated shape. Then, based on the judgment result, the delay time is determined. However, the invention need not be limited to such a configuration. For example, when it is judged that the recording sheet P has the corrugated shape, it is always determined that the recording sheet P has the predetermined corrugated shape and the standard delay time stored in the standard delay time storage unit 76 is used as the delay time to be actually used.

Further, according to the exemplary embodiment, it is judged whether the recoding sheet P has the corrugated shape, and only when the recording sheet P has the corrugated shape the delay time is determined. However, the invention needs not to be limited to such an embodiment. For example, whether the recording sheet P has the corrugated shape or not is not judged, and the delay time is always determined based on the difference between the length, in the scanning direction, of the recording sheet P detected by the sheet width detecting unit 64 and the length, in the scanning direction, of the recording sheet P stored in the reference width storage unit 63.

According to the exemplary embodiment, the predetermined corrugated shape is defined such that the both end portions, in the scanning direction, are deformed to be the valley portions Pv, and therefore, the number of the valley portions Pv is greater than the number of the ridge portions Pm by one. It is noted that the invention needs not be limited to such a configuration. For example, the both end portions, in the scanning direction, may be deformed to be the ridge portions. In such a case, the number of the valley portions Pv is smaller than the number of the ridge portions Pm by one. Alternatively, one end portions, in the scanning direction, may be deformed to be the ridge portion, while the other end portions may be deformed to be the valley portion Pv. In this case, the number of the ridge portions Pm is equal to the number of the valley portions Pv.

In the exemplary embodiment, after the measurement of the length of the recording sheet in the scanning direction and the relative displacement values E at respective portions of the recording sheet P, the recording sheet P used for the measurement is discharged from the inkjet printer 1. The invention needs not be limited to such a configuration. For example, the invention may be applied to a printer which may be configured such that the recording unit 2 has so-called a switch-back mechanism that returns a recording sheet P on which an image is recorded on a front side thereof to an upstream, in the sheet feed direction, with reversing the front/back sides of the recording sheet P so that image can be recorded on the front/back sides of the recording sheet P. In such a case, after the measurement of the length of the sheet P in the scanning direction and the relative displacement amounts at portions on the recording sheet P is executed, the recording sheet P may be conveyed to upstream in the sheet convey direction with reversing the recording sheet P using the switch-back mechanism. Thereafter, recoding on the back surface can be executed.

According to the exemplary embodiment, the measurement of the recording sheet (S102) and determination of the compensation amounts (S103) are executed immediately before images are recorded on the recording sheet P. Such processes can be executed when the recording is not being executed.

According to the exemplary embodiment, the first corrugation judging unit 65 judges whether the recording sheet P has the corrugated shape based on the length of the recording sheet P in the scanning direction, which is detected by the sheet width detecting unit 64. The invention needs not be limited to such a configuration.

For example, instead of using the length of the recording sheet P in the scanning direction, whether the recording sheet P has the corrugated shape or not may be judged based on positional information of the both ends of the recoding sheet in the scanning direction. In such a modification, the reference width storage unit 63 may store the positional information of both sides, in the scanning direction, of the recording sheet P when it is not deformed to be corrugated, instead of the length L of the recording sheet P. The positional information may include numbers representing positions of slits the media sensor 21 detects. Specifically, the positional information includes a number representing a reference slit which the media sensor 21 detects when the inkjet head 12 is located in a stand-by state (i.e., when the recording is not executed). The other slits are represented by numbers counted from the reference slit. The positional information includes, instead of the length L, positions of slits which correspond to both ends (or end portions) of the recording sheet P in the scanning direction. When the sheet width detecting unit 64 detects, with use of the media sensor 21, positions of the both ends (or end portions) of the recording sheet P, then converts the positions into numbers counted from the reference slit.

The first corrugation judging unit 65 compares the numbers of the slits the sheet width detecting unit 64 detects with the slit numbers stored in the reference width storage unit 63. If the detected numbers are not equal to the detected (converted) numbers, the first corrugation judging unit 65 judges that the recoding sheet P is corrugated. If the detected numbers are equal to the detected (converted) numbers, the first corrugation judging unit 65 judges that the recoding sheet P is not corrugated.

Alternatively, instead of using the positional information of the both ends/end portions of the recording sheet P, positional information of only one end (or end portion) may be used to judge whether the recording sheet P is corrugated or not. For example, if the inkjet printer is configured such that one end, in the scanning direction, of the recoding sheet P change its position little regardless whether it is corrugated or not, it is possible to regard that the position of the end of the recording sheet P is fixed. Then, only by detecting the position of the other end, in the scanning direction, of the recording sheet, it is possible to judge whether the recording sheet P is corrugated or not.

Specifically, the reference width storage unit 63 may store the positional information (e.g., the slit number) representing only the position of the other end (i.e., changeable end) when the recoding sheet P is not corrugated. The sheet width detecting unit 64 detects only the position (i.e., the slit number) of the other end (i.e., the changeable end). Then, the first corrugation judging unit 65 judges whether the recording sheet P is not corrugated or corrugated based on whether the detected slit number is equal to the stored positional information or not.

In the exemplary embodiment and modifications, the invention is applied to an inkjet printer configured to eject ink drops from the nozzles. It should be noted that the invention need not be limited to application to the inkjet printers. That is, the invention can be applied to, for example, a liquid ejecting device which is configured to eject liquid other than the ink to a sheet or the like other than the recording sheet P. The invention can also be applied to a liquid ejection method employed in such a liquid ejecting device, and a computer-readable recording medium containing programs which may cause a computer to execute the liquid ejection method and/or modifications as described.

All the functions provided by the controlling device 50 may be provided by a cooperation between the control unit 51 and the ASIC 52, and contribution of the control unit 51 and the ASIC 52 need not be limited to that of the exemplary embodiment, but may be designed in various ways. Further, the exemplary embodiment can be modified such that at least a part of the functions provided by the control unit 51 in the exemplary embodiment may be realized by the ASIC 52.

What is claimed is:

1. A liquid ejecting device, comprising:

a liquid ejecting head configured to eject ink toward a sheet-like object;

a carriage mounting the liquid ejecting head thereon, the carriage being reciprocally movable relative to the sheet-like object in a scanning direction;

a conveying device configured to convey the sheet-like object in a conveying direction which is perpendicular to the scanning direction with holding the sheet-like object to have a corrugated shape exhibiting a corrugation in cross-section taken along a plane extending in the scanning direction and perpendicular to the conveying direction;

a detecting unit configured to detect an end portion of the sheet-like object in the scanning direction; and a processor, the processor being configured to execute instructions to provide:

an ejection timing determining unit configured to determine an ejection timing at which the liquid is ejected from the liquid ejecting head in accordance with positional information representing the end portion detected by the detecting unit and reference information; and an ejection control unit configured to control the liquid ejecting head and the carriage to eject the liquid from the liquid ejecting head at the timing determined by the ejection timing determining unit;

wherein:

the detecting unit is configured to detect both end portions, in the scanning direction, of the sheet-like object;

the ejection timing determining unit determines the ejection timing of the liquid from the liquid ejecting head based on the positional information regarding the both end portions detected by the detecting unit and the reference information;

the reference information represents an original length of the sheet-like object in the scanning direction when the sheet-like object is not corrugated; and the detecting unit measures the length of the sheet-like object based on a result of detection of both ends by the detecting unit;

wherein the ejection timing determining unit includes:

a reference timing generating unit configured to generate a reference timing which is used to generate an ejection timing when the sheet-like object is not corrugated;

a compensation amount determining unit configured to determine compensation amount with respect to the reference timing; and a first corrugation judging unit configured to judge whether the sheet-like object is corrugated, wherein the first corrugation judging unit judges that the sheet-like object is corrugated when a difference between the original length and the measured length of the sheet-like object is equal to or greater than a predetermined difference;

wherein the compensation amount determining unit determines the compensation amount based on a difference; and wherein the ejection timing determining unit determines the reference timing compensated by the compensation amount as the ejection timing at which the liquid is ejected from the nozzle.

2. The liquid ejecting device according to claim 1, wherein:

the first corrugation judging unit judges that the sheet-like object is not corrugated when a difference between the original length and the measured length of the sheet-like object is less than the predetermined difference; and when the first corrugation judging unit judges that the sheet-like object is not corrugated, the ejection timing determining unit determines the reference timing as the ejection timing to be used.

3. The liquid ejecting device according to claim 1, wherein the ejection timing determining unit includes a relative displacement detecting unit configured to detect relative relationship of portions of the sheet-like object with respect to a reference position, the reference position being a position of a portion of the sheet-like object farthest from the liquid ejection surface or closest to the liquid ejection surface, wherein the compensation amount determining unit includes:

an accumulated displacement amount obtaining unit configured to obtain an accumulated displacement amount which is an accumulated value of displacement amounts at portions on the sheet-like object, each of the displacement amounts being a displacement amount with respect to a portion of the sheet-like object closest to or farthest from the liquid ejection surface in a direction perpendicular to the liquid ejection surface, based on the length measured by the detecting unit and the original length of the sheet-like object when the first corrugation judging unit judges that the sheet-like object is corrugated;

an accumulated compensation amounts determining unit configured to determine an accumulated compensation amount by accumulating the compensation amount for the ejection timing of the liquid to reach a corresponding portion of the sheet-like object; and a compensation amount distributing unit configured to distribute the accumulated compensation amount to the ejection timings at which the ink reach the respective portions of the sheet-like object based on the relative displacement amount for respective portions of the sheet-like object detected by the relative displacement value detecting unit, wherein the compensation amount distributing unit distributes the accumulated compensation amount such that the smaller a distance between the sheet-like object and the liquid ejection surface is, the more the ejection timing is delayed.

4. The liquid ejecting device according to claim 1, wherein:

the conveying device is configured to hold the sheet-like object such that the sheet-like object is deformed to have a first number of ridge portions which are closer to the liquid ejection surface and a second number of valley portions which are farther from the liquid ejection surface, the first number of ridge portions and the second number of valley portions being alternately arranged in the scanning direction, the liquid ejecting device has a sensor and the process further provides a counter configured to count the number of the ridge portions and valley portions held by the conveying device with use of the sensor, the liquid ejecting device has a standard compensation amount storage configured to store a standard compensation amount which is a compensation amount when the sheet-like object held by the conveying device has the corrugated shape, the processor further provides a second corrugation judging unit configured to judge whether the sheet-like object has the corrugated shape when the first corrugation judging unit judges that the sheet-like object has the corrugated shape, the second corrugation judging unit judges the sheet-like object has a predetermined corrugated shape when a difference between the length of the sheet-like object measured by the detecting unit and the length of the sheet-like object in the scanning direction when the sheet-like object is not corrugated is equal to or greater than a second predetermined difference which is greater than the first predetermined difference and the number of the ridge portions counted by the counter is the first predetermined number and the valley portions counted by the counter is the second predetermined number, when the second corrugation judging unit judges that the sheet-like object has the predetermined corrugated shape, the compensation amount determining unit determines the standard compensation amount as the compensation amount to be applied.

5. The liquid ejecting device according to claim 1, wherein:

the conveying device is configured to hold the sheet-like object such that the sheet-like object is deformed to have a first number of ridge portions which are closer to the liquid ejection surface and a second number of valley portions which are farther from the liquid ejection surface, the first number of ridge portions and the second number of valley portions being alternately arranged in the scanning direction, the liquid ejecting device has a sensor and the process further provides a counter configured to count the number of the ridge portions and valley portions held by the conveying device with use of the sensor, the liquid ejecting device has a standard post-compensation amount storage configured to store a post-compensation timing, the post-compensation timing being obtained by compensating the reference timing with a standard compensation amount which is a compensation amount when the sheet-like object held by the conveying device has a predetermined corrugated shape, the processor further provides a second corrugation judging unit configured to judge whether the sheet-like object has the predetermined corrugated shape when the first corrugation judging unit judges that the sheet-like object has the corrugated shape, the second corrugation judging unit judges the sheet-like object has the predetermined corrugated shape when a difference between the length of the sheet-like object measured by the detecting unit and the length of the sheet-like object in the scanning direction when the sheet-like object is not corrugated is equal to or greater than a second predetermined difference which is greater than the first predetermined difference and the number of the ridge portions counted by the counter is the first predetermined number and the valley portions counted by the counter is the second predetermined number, when the second corrugation judging unit judges that the sheet-like object has the predetermined corrugated shape, the compensation amount determining unit determines the post-compensation timing as the ejection timing to be applied.

6. The liquid ejecting device according to claim 1, wherein the compensation amount determining unit determines a delay time for the reference timing as the compensation amount, and the compensation amount determining unit determines the delay time for each of the ejection timings at which the ink is ejected to reach respective portions on the sheet-like object such that the delay time for the ejection timing at which the ink is ejected and reaches the farthest portion of the sheet-like object from the liquid ejection surface is zero.

7. The liquid ejection device according to claim 1, wherein:

the conveying device coveys the sheet-like object in a direction parallel with the liquid ejection surface and in a direction intersecting with the scanning direction;

the conveying device includes:

a pair of upstream rollers arranged on an upstream, in the conveying direction, of the liquid ejection surface, the pair of upstream rollers sandwiching the sheet-like object and feeding the sheet-like object in the conveying direction; and a pair of downstream rollers arranged on a downstream, in the conveying direction, of the liquid ejection surface, the pair of downstream rollers sandwiching the sheet-like object and feeding the sheet-like object in the conveying direction, the detecting unit detects both end portions of the sheet-like object when the sheet-like object is in each of:

a first state in which the sheet-like object is sandwiched by the pair of upstream rollers but not sandwiched by the pair of downstream rollers;

a second state in which the sheet-like object is sandwiched by the pair of upstream rollers and by the pair of downstream rollers; and a third state in which the sheet-like object is not sandwiched by the pair of upstream rollers but sandwiched by the pair of downstream rollers, the ejection timing determining unit determines the ejection timing at each of the first, second and third states.

8. The liquid ejecting device according to claim 1, wherein the processor further provides a sheet type change judging unit configured to judge whether the type of the sheet-like object is changed, and wherein, when the sheet type change judging unit judges that the type of the sheet-like object has been changed:

the detecting unit detects the length of the sheet-like object; and the timing determining unit determines the ejection timing based on a difference between the measured length of the sheet-like object and the original length of the sheet-like object when the sheet-like object is not corrugated.

9. The liquid ejecting device according to claim 8, wherein:

the liquid ejecting device further comprises:

a sheet tray configured to accommodate the sheet-like object; and a attachment/detachment detecting unit configured to detect attachment/detachment of the sheet tray, the change judging unit judges that the type of the sheet-like object has been changed when the attachment/detachment detecting unit detects that the sheet tray is detached, and then attached.

10. The liquid ejecting device according to claim 1, wherein the processor further provides:

a sheet type change judging unit configured to judge whether the type of the sheet-like object is changed;

a notification command transmission unit configured to transmit a notification command instructing to notify that the type of the sheet-like object has been changed when it is detected by the sheet type change judging unit;

a decision command receiving unit configured to receive a decision command instructing to determine the ejection timing, which command is input by a user after a notification is made in response to receipt of the notification command transmitted by the notification command transmission unit, wherein, when the determination command is received:

the detecting unit measures the length of the sheet-like object; and the ejection timing determining unit determines the ejection timing from the nozzle based on a difference between the length of the sheet-like object measured by the detecting unit and the length, in the scanning direction, of the sheet-like object when the sheet-like object is not corrugated.

11. The liquid ejecting device according to claim 10, wherein the processor further provides:

a switching command receiving unit configured to receive a switching command instructing whether or not to control the notification command transmitting unit to transmit the notification command or not to transmit the notification command; and a notification command switching unit configured to control the notification command transmitting unit to transmit the notification command or not to transmit the notification command, when the switching command receiving unit has received the switching command, based on the received switching command.

12. A liquid ejecting method for a liquid ejecting device having a liquid ejecting head configured to eject ink to a sheet-like object, a carriage mounting the liquid ejecting head thereon, the carriage being reciprocally movable relative to the object in a scanning direction, and a conveying device configured to convey the sheet-like object in a conveying direction, the liquid ejecting method comprising:

conveying the sheet-like object with holding the sheet-like object to be deformed to have a corrugated shape exhibiting a corrugation in cross-section taken along a plane extending in the scanning direction and perpendicular to the conveying direction;

detecting an end portion of the sheet-like object in the scanning direction;

determining an ejection timing at which the liquid is ejected from the liquid ejecting head in accordance with positional information representing the end portion as detected and reference information; and controlling the liquid ejecting head and the carriage to eject the liquid from the liquid ejecting head at the timing determined by execution of determining the ejection timing;

wherein:

the detecting step detects both end portions, in the scanning direction, of the sheet-like object;

the ejection timing determining step determines the ejection timing of the liquid from the liquid ejecting head based on the positional information regarding the both end portions detected by the detecting step and the reference information;

the reference information represents an original length of the sheet-like object in the scanning direction when the sheet-like object is not corrugated; and the detecting step measures the length of the sheet-like object based on a result of detection of both ends by the detecting step; and wherein the ejection timing determining step includes:

generating a reference timing which is used to generate an ejection timing when the sheet-like object is not corrugated;

determining compensation amount with respect to the reference timing; and judging whether the sheet-like object is corrugated, wherein the judging judges that the sheet-like object is corrugated when a difference between the original length and the measured length of the sheet-like object is equal to or greater than a predetermined difference;

wherein the compensation amount determining determines the compensation amount based on a difference; and wherein the ejection timing determining determines the reference timing compensated by the compensation amount as the ejection timing at which the liquid is ejected from the nozzle.

13. A non-transitory computer-readable storage medium containing executable instructions regarding a liquid ejecting method for a liquid ejecting device which has a liquid ejecting head configured to eject ink to a sheet-like object, a carriage mounting the liquid ejecting head thereon, the carriage being reciprocally movable relative to the object in a scanning direction, and a conveying device configured to convey the sheet-like object in a conveying direction, wherein the instructions cause, when executed, a computer to execute:

conveying the sheet-like object with holding the sheet-like object to be deformed to have a corrugated shape exhibiting a corrugation in cross-section taken along a plane extending in the scanning direction and perpendicular to the conveying direction;

detecting an end portion of the sheet-like object in the scanning direction;

determining an ejection timing at which the liquid is ejected from the liquid ejecting head in accordance with positional information representing the end portion detected as detected and reference information; and controlling the liquid ejecting head and the carriage to eject the liquid from the liquid ejecting head at the timing determined by execution of determining the ejection timing;

wherein:

the detecting step detects both end portions, in the scanning direction, of the sheet-like object;

the ejection timing determining step determines the ejection timing of the liquid from the liquid ejecting head based on the positional information regarding the both end portions detected by the detecting step and the reference information;

the reference information represents an original length of the sheet-like object in the scanning direction when the sheet-like object is not corrugated; and the detecting step measures the length of the sheet-like object based on a result of detection of both ends by the detecting step;

wherein the ejection timing determining step includes:

generating a reference timing which is used to generate an ejection timing when the sheet-like object is not corrugated;

determining compensation amount with respect to the reference timing; and judging whether the sheet-like object is corrugated, wherein the judging judges that the sheet-like object is corrugated when a difference between the original length and the measured length of the sheet-like object is equal to or greater than a predetermined difference;

wherein the compensation amount determining determines the compensation amount based on a difference; and wherein the ejection timing determining determines the reference timing compensated by the compensation amount as the ejection timing at which the liquid is ejected from the nozzle.

14. A liquid ejecting device, comprising:

a liquid ejecting head configured to eject ink toward a sheet-like object;

a carriage mounting the liquid ejecting head thereon, the carriage being reciprocally movable relative to the sheet-like object in a scanning direction;

a conveying device configured to convey the sheet-like object in a conveying direction which is perpendicular to the scanning direction with holding the sheet-like object to have a corrugated shape exhibiting a corrugation in cross-section taken along a plane extending in the scanning direction and perpendicular to the conveying direction;

a detecting unit configured to detect an end portion of the sheet-like object in the scanning direction; and an integrated circuit configured to be implemented with:

an ejection timing determining function to determine an ejection timing at which the liquid is ejected from the liquid ejecting head in accordance with positional information representing the end portion detected by the detecting unit and reference information; and an ejection control function to control the liquid ejecting head and the carriage to eject the liquid from the liquid ejecting head at the timing determined by the ejection timing determining function;

wherein:

the detecting unit is configured to detect both end portions, in the scanning direction, of the sheet-like object;

the ejection timing determining function determines the ejection timing of the liquid from the liquid ejecting head based on the positional information regarding the both end portions detected by the detecting unit and the reference information;

the reference information represents an original length of the sheet-like object in the scanning direction when the sheet-like object is not corrugated; and the detecting unit measures the length of the sheet-like object based on a result of detection of both ends by the detecting unit;

wherein the ejection timing determining function includes:

generating a reference timing which is used to generate an ejection timing when the sheet-like object is not corrugated;

determining compensation amount with respect to the reference timing; and judging whether the sheet-like object is corrugated, wherein the judging judges that the sheet-like object is corrugated when a difference between the original length and the measured length of the sheet-like object is equal to or greater than a predetermined difference;

wherein the compensation amount determining determines the compensation amount based on a difference; and wherein the ejection timing determining function determines the reference timing compensated by the compensation amount as the ejection timing at which the liquid is ejected from the nozzle.

* * * * *